US006293845B1

(12) United States Patent
Clark-Phelps

(10) Patent No.: US 6,293,845 B1
(45) Date of Patent: Sep. 25, 2001

(54) SYSTEM AND METHOD FOR END-POINT DETECTION IN A MULTI-HEAD CMP TOOL USING REAL-TIME MONITORING OF MOTOR CURRENT

(75) Inventor: Robert B. Clark-Phelps, San Jose, CA (US)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/391,073

(22) Filed: Sep. 4, 1999

(51) Int. Cl.[7] ..... B24B 49/00; B24B 51/00

(52) U.S. Cl. ..... 451/5; 451/8; 451/9; 451/10; 451/41; 451/54; 156/345

(58) Field of Search ..... 451/5, 8, 9, 10, 451/41; 156/345

(56) References Cited

U.S. PATENT DOCUMENTS

| | | | | |
|---|---|---|---|---|
| 4,768,308 | * | 9/1988 | Atkinson, III et al. | 451/5 |
| 4,926,603 | * | 5/1990 | Frost et al. | 451/5 |
| 5,036,015 | * | 7/1991 | Sandhu et al. | 438/14 |
| 5,069,002 | * | 12/1991 | Sandhu et al. | 451/1 |
| 5,265,378 | * | 11/1993 | Rostoker | 451/9 |
| 5,308,438 | * | 5/1994 | Cote et al. | 216/86 |
| 5,639,388 | * | 6/1997 | Kimura et al. | 216/84 |
| 5,667,424 | * | 9/1997 | Pan | 451/5 |
| 5,685,766 | * | 11/1997 | Mattingly et al. | 451/5 |
| 5,830,041 | * | 11/1998 | Takahashi et al. | 451/8 |
| 5,851,135 | * | 12/1998 | Sandhu et al. | 451/5 |
| 5,872,633 | * | 2/1999 | Holzapfel et al. | 451/6 |
| 5,910,040 | * | 6/1999 | Moriyasu et al. | 451/5 |
| 5,958,148 | * | 9/1999 | Holzapfel et al. | 451/6 |
| 6,007,405 | * | 12/1999 | Mei | 451/5 |
| 6,012,970 | * | 1/2000 | Nagabushnam | 451/41 |
| 6,077,783 | * | 6/2000 | Allman et al. | 451/288 |
| 6,093,280 | * | 7/2000 | Kirchner et al. | 451/5 |
| 6,106,662 | * | 8/2000 | Bibby, Jr. et al. | 451/287 |

* cited by examiner

*Primary Examiner*—M. Rachuba
(74) *Attorney, Agent, or Firm*—Flehr Hohbach Test Albritton & Herbert LLP

(57) ABSTRACT

A method and system for detecting a planarization endpoint of a semiconductor wafer planarization operation, which includes monitoring a motor current for at least one of a platen motor, a carousel motor and a head motor, performing a Fourier transform of the monitored current to identify periodic oscillations in the current, to ensure that undesirable oscillations in the monitored motor current are minimized, to provide better reliability and higher precision of end-point detection triggering.

21 Claims, 21 Drawing Sheets

SYSTEM AND METHOD FOR END-POINT DETECTION IN A MULTI-HEAD CMP TOOL USING REAL-TIME MONITORING OF MOTOR CURRENT

FIELD OF THE INVENTION

This invention pertains generally to semiconductor fabrication procedures, and more particularly to a system and method for end-point detection in a multi-head Chemical Mechanical Planarization tool using real-time monitoring of polishing machine motor current.

BACKGROUND

Real-Time Monitoring (RTM) of chemical mechanical planarization (CMP) processes is currently a subject of great interest and active development. Also known as in situ monitoring or end-point detection, RTM compensates for process variations by automatically adjusting the polishing time for each polishing run. The result is improved process stability, better centering of the process on a desired target, and a reduced need for operator intervention. In addition to its enabling role in end-point detection, Real-time monitoring provides a wealth of data on physical characteristics of the polisher during operation. As will be described, these RTM data are valuable for understanding fundamental aspects of the polishing process, for identifying unusual conditions which indicate a need for unscheduled maintenance of the equipment, and for tuning the polishing process, among other benefits.

Many methods for performing RTM of CMP processes have been proposed. The techniques which have received the most attention use three different types of signals: optical reflectance, motor current, and polishing pad temperature. Other methods have also been explored, such as the use of vibrations. All of these different methods employ a signal which monitors the progress of a single polishing run in real time and provides a characteristic triggering feature used to halt the polish step of the recipe. By adjusting the polishing time, RTM compensates for variations in the polisher's removal rate, including for example long-term drifts due to polishing pad wear. Likewise, RTM can compensate for fluctuations in film thickness of incoming wafers caused by variations in the deposition process.

Unfortunately, the processes, methods, and physical structures for accurate RTM have not been completely satisfactory. Particularly lacking have been structures and methods that are useful for multi-head CMP machines, especially when one or more motors are shared between the several heads.

SUMMARY

The invention provides a system and method for end-point detection in a multi-head Chemical Mechanical Planarization tool using real-time monitoring of polishing machine motor current. In one aspect the invention provides structure and method for determining the end-point or point of completion of any process step. In another aspect, the invention provides structure and method for optimumly conditioning a polishing pad. In another aspect the invention provides a CMP machine having a motor current sensing end-point detection apparatus. In another aspect the invention provides a computer program product having a procedure for impementing in a processor and memory of a general purpose computer for operating the CMP machine and implementing the real-time end-point detection.

DETAILED DESCRIPTION OF EMBODIMENTS OF THE INVENTION

I. Introduction

This description describes the results of motor-current RTM on a multi-head CMP platform, the Isoplanar 8000 polisher from Cybeq Nano Technologies (CNT) a subsidiary of Mitsubishi Materials Corporation. The primary focus of the work is tungsten CMP. Data for aluminum, copper, and shallow trench isolation (STI) applications are also presented. The remainder of the Detailed Description of Embodiments of the Invention organized into several sections. In Section II, are described general considerations relevant to the use of motor-current RTM on CNT's multi-head CMP platform: the types of motor current signals available on the IP8000, choosing the best signal to use for end-point detection, the relationship between the different motor current signals, and the effects of signal averaging. Section III focuses on a description of RTM data for tungsten CMP, including results for patterned contact test wafers from Sematech. Data on the triggering reliability of the RTM system are presented. Section IV summarizes RTM data on other applications, including aluminum, Copper, and STI. Section V discusses applications of RTM data which are not directly related to end-point detection, such as the use of RTM data to better understand the polishing process or the tool. Section VI summarizes some of the results and conclusions.

II. Motor Current Signals on a Multi-head CMP Platform

Figure 1:
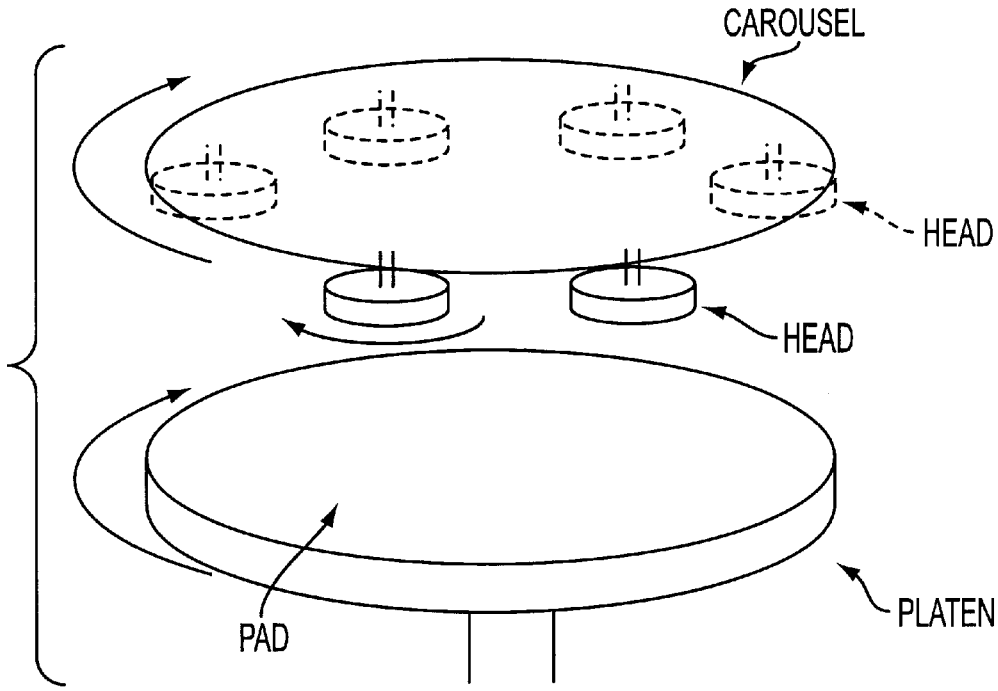
FIG. 1 shows a schematic of IP8000 polisher showing three axes of rotation.

A schematic diagram of the IP8000, an exemplary CMP machine, is shown in FIG. 1. While some of the results are described relative to this machine, it should be understood that neither they nor the claimed invention are limited to this particular machine nor to this particular type of machine.

The IP8000 system is configured as a single platen, six-head rotary polisher for high throughput. The six heads are mounted on a carousel which rotates in the same direction as the platen but at a lower rotational speed. To minimize parts and enhance the system's process stability, all six heads are driven by a single motor and supplied with compressed air from a single regulator. Thus there are three motors in the system: platen motor, heads motor, and carousel motor.

The motor current EPD technique is used when clearing the top layer of a structure with a significant difference in friction between the top layer and the second layer, such as metal layer or film on oxide. When the interface is reached, the change in the friction between the wafers (or other substrate being polished) and the polishing pad causes a change in the torques acting on the platen, carousel, and heads. Because the motors are commanded to rotate at fixed speeds, more or less current must be supplied to respond to the change in torque. The change in motor current provides the signal to stop the polish step and proceed to the next step, usually the rinse step.

Figure 2:
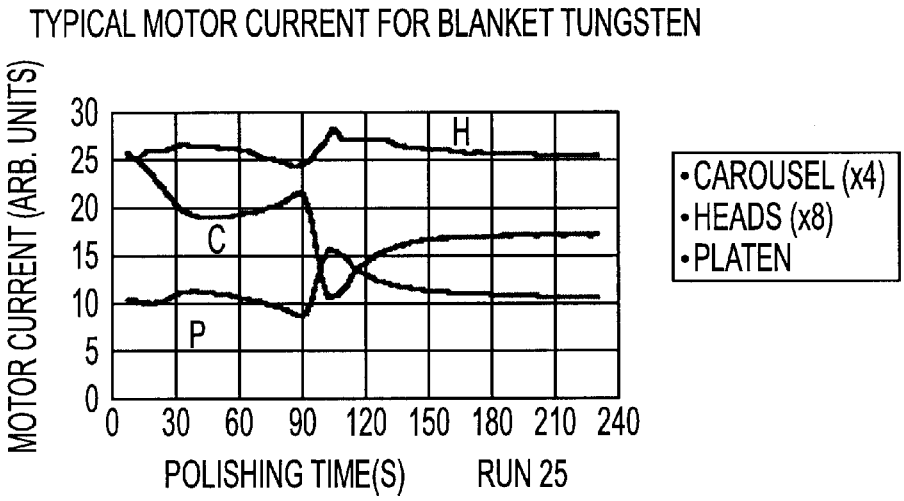
FIG. 2 shows typical motor current signals for a blanket tungsten /TiN/Ti/thermal oxide stack.

An example of the motor current signals for a blanket tungsten film on oxide is shown in FIG. 2. The layer stack for this wafer was 5.7 k Å tungsten/800 Å TiN/400 Å Ti/4 k Å thermal oxide. The prominent features between 90 and 120 seconds correspond to the TiN and Ti layers. The correspondence between the peaks in the motor current and the layers of the stack are described in Section III.

Two general features of the motor current signals merit comment and explanation. First, the features in the head signal are a factor of 5 to 10 weaker than the platen and carousel signals. Second, the carousel and platen signals move opposite each other in a highly symmetrical fashion. To understand these observations, the mechanics of the polisher are now described in more detail.

Over a large range of the pressures and speeds typically used in CMP, the removal rate obeys an empirical relationship known as Preston's Law:

$$RR=K_p P V_{rel} \tag{1}$$

where RR is the removal rate, P is the pressure, $V_{rel}$ is the relative velocity between the wafer and the pad, and $K_p$ is the Preston coefficient. Preston's law implies that, to first order, uniform removal over the surface of the wafer is achieved by making the pressure and relative velocity the same at all points on the wafer. The IP8000 uses a floating-head polishing head design to distribute pressure uniformly. One example of a floating-head type polishing head design are described in U.S. Pat. Nos. 5,205,082; 4,918,870; and 5,443,416; each of which is herein incorporated by reference. To obtain uniform relative velocity, the rotational speeds of the three motors are selected according to a 'golden rule':

$$\omega_p=\omega_C+\omega_H) \tag{2}$$

where $\omega_p$ is the rotational speed of the platen, $\omega_c$ is the rotational speed of the carousel, and $\omega_H$ is the rotational speed of the heads.

Figure 3:
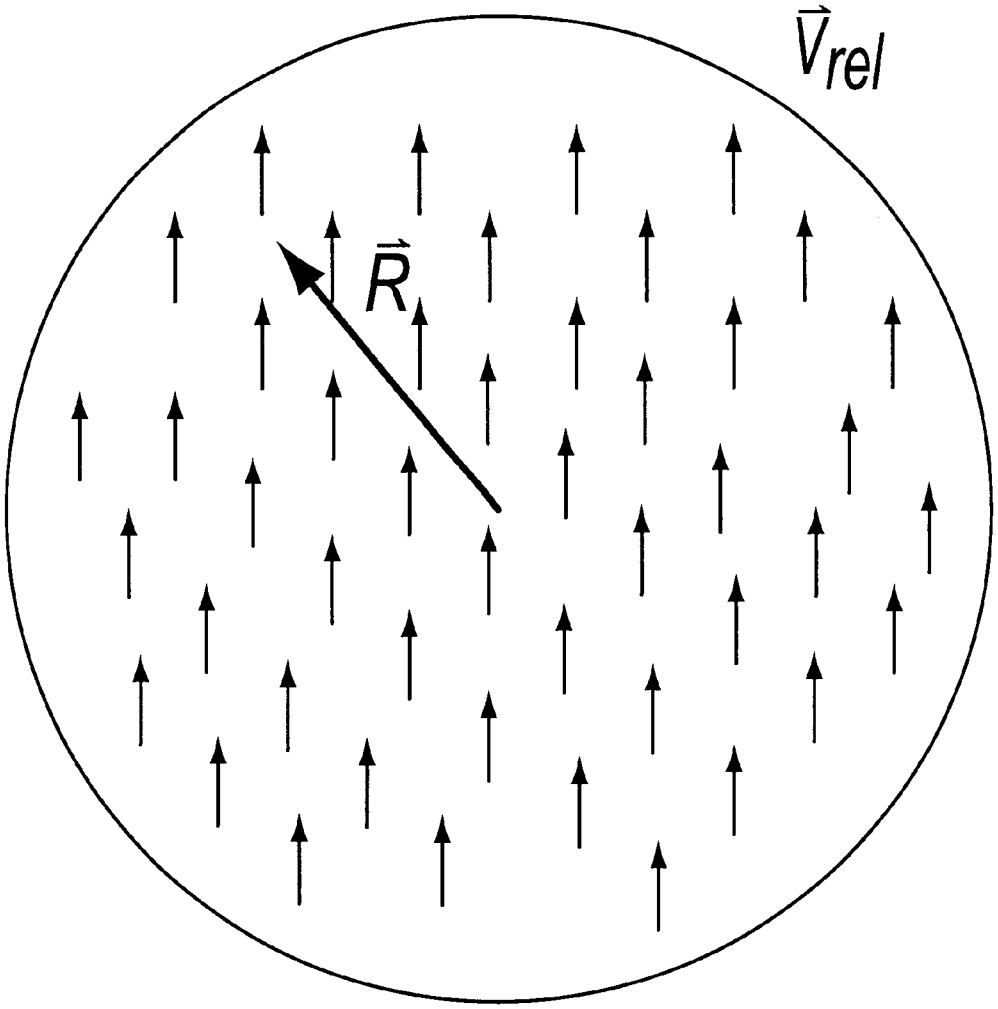
FIG. 3 shows relative velocity field across the wafer, where the net torque about the center of the wafer is zero.
Figure 4:
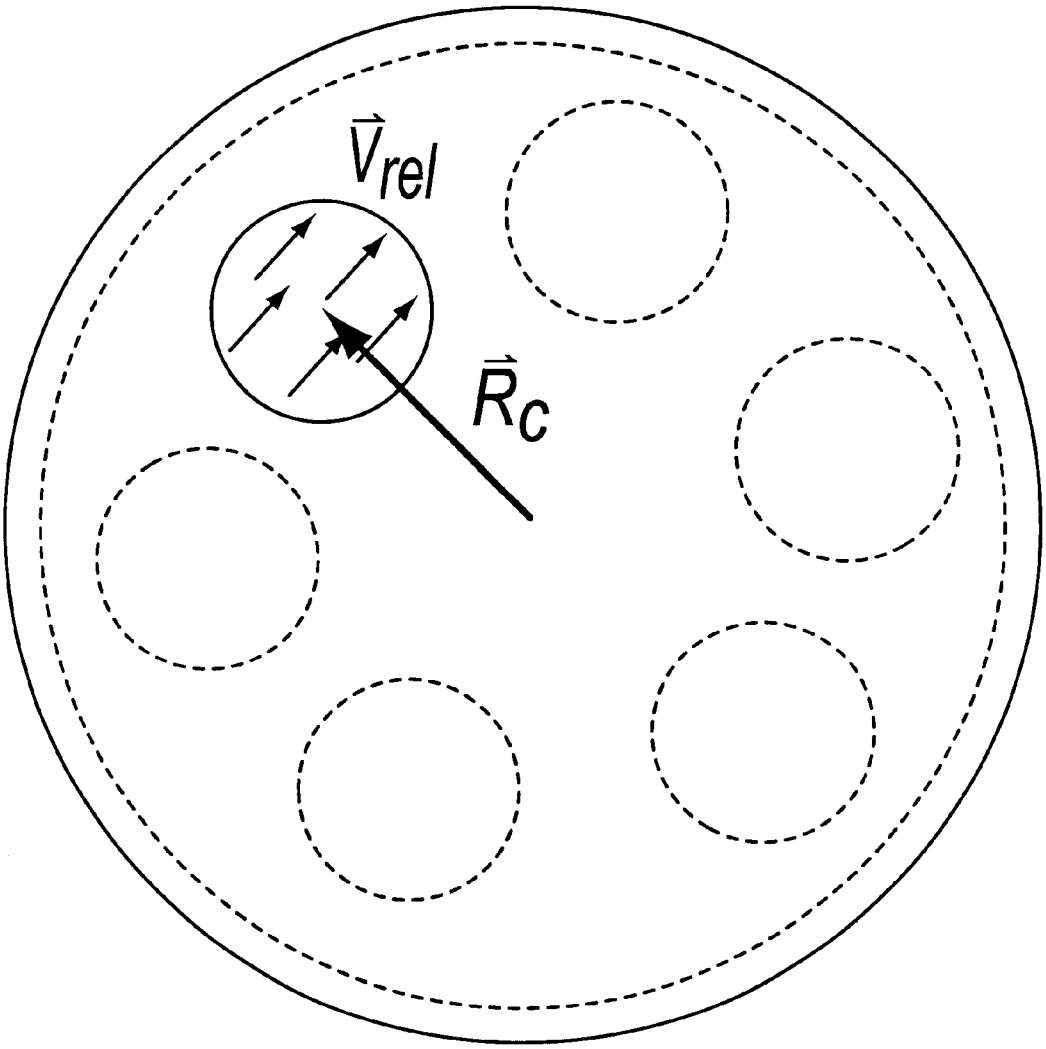
FIG. 4 shows relative velocity field produces non-zero net torque about carousel and platen axes.

The uniformity of $V_{rel}$ at all points on the wafer creates a highly symmetric distribution of frictional force across the head, as shown in FIG. 3. The arrows indicate the relative velocity field. If one assumes the pressure and coefficient of friction are also constant across the wafer, then the field of the frictional force will point in the opposite direction to oppose the motion of the wafer but will have the same high degree of symmetry. Because torque is the cross-product of the radius vector and the force, the net torque about the center of the head is zero. Under these assumptions, the motor current to the heads is completely insensitive to changes in friction, because the net torque always sums to zero regardless of the size of the frictional force. In a real system, the coefficient of friction and the pressure are not constant, and there is always some within-wafer non-uniformity in the polish process. For example, the center of the wafer clears before the edges for the tungsten process shown in FIG. 2. Hence, the change in friction at the interface produces a noticeable signal in the head current. However, there is still cancellation for any torques with circular symmetry about the center of the head, and those that do not cancel occur only at radii from zero to 10 cm. The torques acting the platen and carousel, by contrast, add together (both within-wafer and wafer-to-wafer), as shown in FIG. 4. Furthermore, they occur at radii from 10 cm to 50 cm, creating a larger torque for a given force. Thus, the platen and carousel signals at the metal/oxide interface are much stronger than those from the heads, and they provide better trigger signals for end-point detection.

Figure 5:
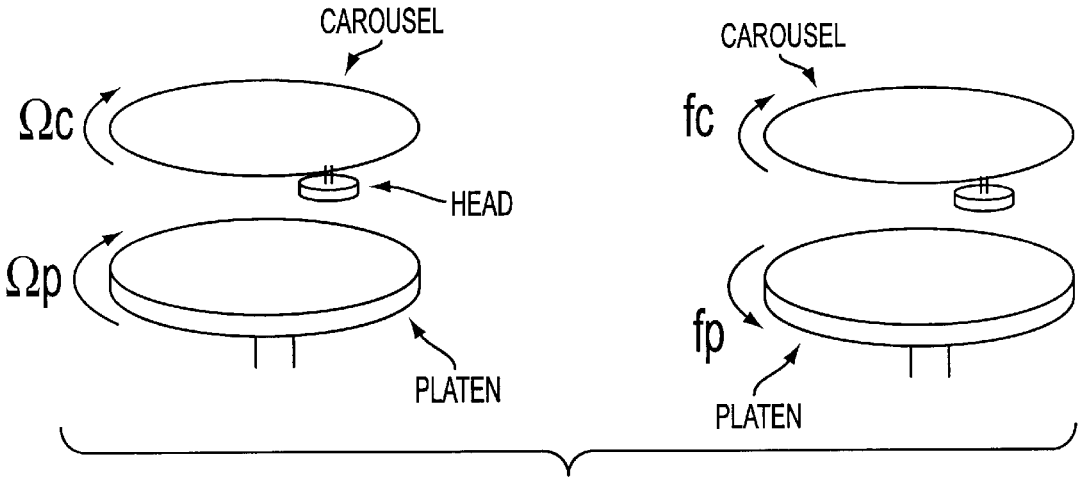
FIG. 5 shows rotation and frictional forces on the platen and carousel.

The reason for the symmetry of the platen and carousel signals is illustrated in FIG. 5. If the polisher is operated according the 'golden rule' (Eq. 2), then the platen rotation is faster than that of the carousel. This means that the force of friction acts to retard the platen and accelerate the carousel. The result is that the carousel and platen signals move in opposite directions as shown in FIG. 2.

Figure 6:
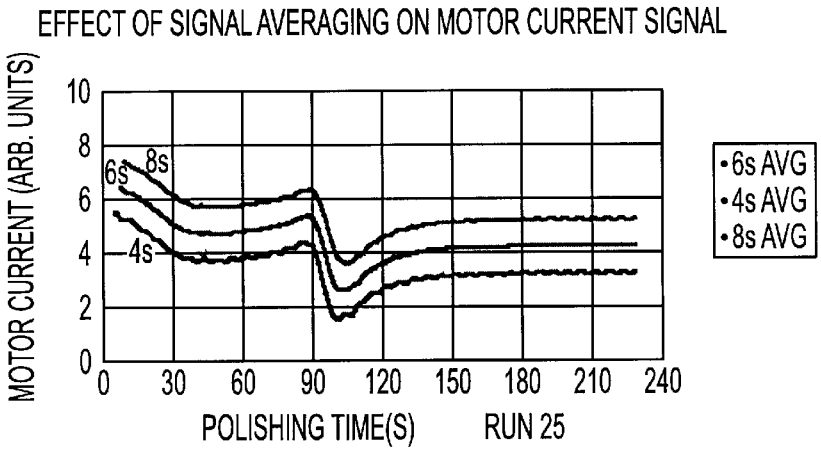
FIG. 6 shows the carousel current from FIG. 2 processed using three different times for the moving signal average.

Finally, the research considers the effect of signal averaging on the motor current signals. The Luxtron system provides for up to three independent time periods to be used in moving averages of the signal. These periods are used to suppress undesirable oscillations which may arise because of mechanical or other effects. FIG. 6 shows the effect of choosing different moving averages for the carousel current from FIG. 2. The period which yields the smoothest curve is 6 s. This period corresponds to a frequency of 0.167 Hz or 10 rpm, which was the rotational speed of the carousel in this process. Without benefit of theory, it is hypothesized that six second oscillation arises from small deviations from parallelism in the platen-carousel run-out. In general, the study found that the platen and carousel signals are smoothest when averaged over the period of the carousel rotation, and the head signal is smoothest when averaged over the periods of both the carousel and head rotations. Minimizing the oscillations due to mechanical effects improves the reliability and reproducibility of EPD triggering. More detailed discussion of the oscillations in the motor current signal is found in Section V.

III. Application to EPD of a Tungsten CMP Process

CMP of tungsten contacts was an early application of the motor current EPD technique. The work presented in this section represents an application of RTM on a multi-head tool to CMP of tungsten contacts. A Luxtron Optima 9300 motor current end-point detection system was used on the Cybeq 8000 polisher. Data is included on the reliability of the EPD triggering as the polishing pad ages and is replaced.

A. Experimental Procedures

The consumable set for the tungsten process was SS-W2000 slurry from Cabot Corporation, an IC-1400 A4 k-groove polishing pad from Rodel, Inc., and R200-T3 inserts from Rodel. Blanket tungsten wafers from Sematech were used having the layer stack 5.7 k Å W/800 Å TiN/400 Å Ti/4 k Å Thermal Oxide/Si, and etch contact tungsten wafers from Sematech with the stack 5 k Å W/400 Å TiN/250 Å Ti/5.5 k Å PETEOS/Si (product code 926CMP023). Wafers were polished one at a time, and the other five heads were retracted. The head pressure and linear velocity were 5 psi and 84 ft/min, respectively. New pads were broken in using the following procedure.

3 dummy oxide runs with SS-W2000 (6 wafers, 3.5 mins per run)

2 dummy tungsten runs (6 wafers, 2 mins per run, polish to clear)

1 dummy oxide run with SS-W2000 (1 wafer, 1 min run)

On a pad which was already broken in, the following sequence of dummy runs was performed at the beginning of each day to prepare for testing:

1 dummy oxide run with SS-W2000 (6 wafers, 2 mins)

1 dummy tungsten run (1 wafer, 2 mins, polish to clear)

1 dummy oxide run with SS-W2000 (1 wafer, 1 min run)

1 monitor tungsten run (1 wafer, 1 min polish) to check the tungsten removal rate End-point recipes were developed for both blanket and patterned wafers. A total of twenty blanket and twenty patterned tungsten wafers were polished. Before each tungsten run, a dummy oxide run with SS-W2000 slurry was performed, so the total number of runs was more than eighty. Half the tungsten runs were performed using motor-current EPD, and the other half were polished by specifying the polish time. The time-based recipes were adjusted each day by measuring a tungsten monitor wafer to determine the tungsten removal rate. Except for a minor re-tuning of the patterned wafer EPD recipe on the last day of the experiments, the EPD recipes were kept the same througout the testing.

Several factors were varied to test the reliability of the EPD system. First, several wafers were pre-polished to simulate the effect of varying the film thickness of the incoming wafers. The pre-polishing removed approximately 4% of the tungsten on the blanket wafers and 13% on the patterned wafers. Second, a pad change was performed. Third, the new pad was conditioned continuously to remove 63 $\mu$m of pad material, simulating aging of the pad from roughly one-third to two-thirds of its useful life.

B. Results for Blanket Tungsten Wafers

1. Motor Current Signals

The motor current signals for a typical blanket tungsten wafer were shown in FIG. 2 above. The peaks and valleys observed in these signals between 90 and 120 s correspond to sudden changes in friction due to clearing of layers in the stack. In interpreting the features in the motor current signal, it is important to keep in mind that the polish always has some degree of non-uniformity which causes parts of the wafer to clear faster than others. One expects the features in the motor current signal to correspond to an 'average' time to clear the layer, when the friction is changing rapidly. Complete clearing of a layer takes longer and will likely not correspond to any obvious feature in the motor current signal because the change in friction may be quite small when the final few percent of a given layer are being cleared. In the case of thin barrier layers, it is possible for more than two layers to be exposed at the same time. Operationally, the Luxtron system defines the "end-point" as the peak or other feature from the motor current signal which identifies the interface, and "end-of-step" as the time when polishing is halted. The time between the end-point and the end-of-step is called the overpolish. The overpolish can be a fixed amount of time or a specified percentage of the time up to the end-point. The purpose of the overpolish is to ensure that the top layer (or layers) is completely cleared.

The first dramatic change in the motor current signals occurs at approximately 88 s. If one interprets this point as the average time to clear the layer, one obtains an average removal rate for tungsten of 3911 Å/min. This rate is consistent with values published by Cabot for typical removal rates with SS-W2000. Our measurements of removal rates on tungsten monitor wafers polished for one minute were significantly lower, ranging from 2882 Å/min to 3216 Å/min. Part of this difference may be attributable to low removal rates during the beginning of the polish. The study measured average removal rates as low as 840 to 974 Å/min during the first 15 s of polishing. For this analysis, the analysis uses the rate of 3911 Å/min.

Using selectivity data provided by Cabot Corporation and the tungsten removal rate discussed above, the estimated times required for average clearing and complete clearing of the metal layers in the stack were determined. The estimated times are shown in Table 1.

TABLE 1

Estimated Time to Clear Blanket Layers

| Layer | Thickness (Å) | Avg. R.R. (Å/min) | Selectivity X:W | Avg. Time to Clear (s) | Max. Time to Clear (s) |
|---|---|---|---|---|---|
| W | 5736 | 3911 | — | 88 | 94 |
| TiN | 800 | 3008 | 1:1.3 | 16 | 17 |
| Ti | 400 | 1956 | 1:2 | 12 | 13 |
| Total | 6936 | — | — | 116 | 124 |
| Oxide | 4000 | 39 | 1:100 | — | — |

The 10% difference between the average time to clear and the maximum time to clear was estimated using the difference between the average and minimum removal rates for tungsten monitor wafers based on 49 point polar maps.

Figure 7:
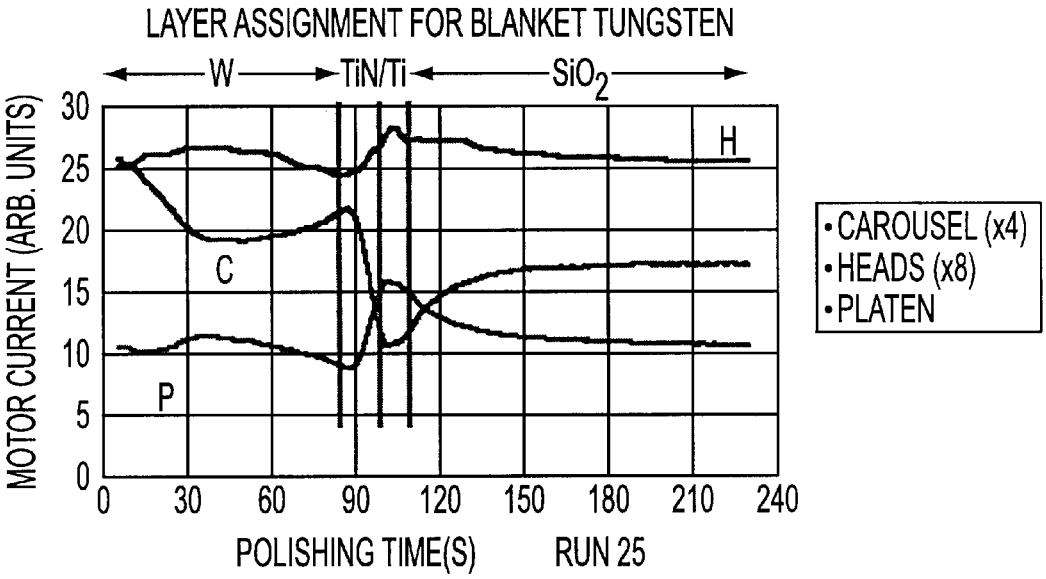
FIG. 7 shows layer assignments for blanket tungsten stack, based on changes of slope observed in motor current signals.

Examining the motor current signals in FIG. 2, one notes several abrupt changes in slope which indicate sudden changes in friction. If one assumes that these abrupt changes mark the average time to clear layers, one can divide the motor current traces into intervals, as shown in FIG. 7 . The length of these intervals is summarized in Table 2:

TABLE 2

Time Intervals from Measured Motor Current Signal

| Layer | Avg. Time to Clear (s) | Max. Time to Clear (s) |
|---|---|---|
| W | 88 | — |
| TiN | 15 | — |
| Ti | 9 | — |
| W/TiN/Ti | 112 | |
| Oxide | — | — |

The maximum time to clear the metal layers is listed as greater than 229 s because a thin band of residual metal near the edge of the wafer remained at the end of this polish time. As discussed below in the section on reliability, this metal was deliberately left on the wafer as a means of testing the reproducibility of the EPD system. The agreement between the measured and estimated times of average clearing for the Ti and TiN layers is good, but the measured time for complete clearing of the metal is actually greater than the estimate. This result indicates that there is a significant drop in removal rate of the Ti layer as complete clearing is approached.

Figure 8:
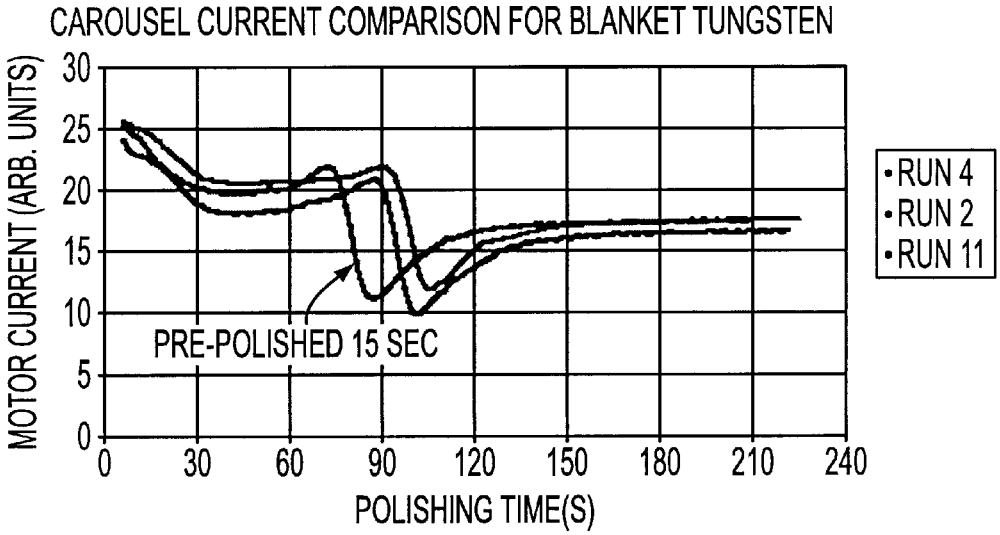
FIG. 8 shows a comparison of carousel current from different polishing runs showing the reproducibility of the triggering features.

The reproducibility of the motor current signal is shown in FIG. 8. The carousel current is shown for three polish runs, including one pre-polished wafer. The data show clear trigger features which are reproducible from run to run and day to day, and which move as expected when the initial film thickness is changed.

2. Blanket W EPD Reliability

A) Method for Measuring Reliability

To obtain a quantitative measurement of the reproducibility of the EPD system, a dense, 481-point Cartesian grid on the blanket tungsten wafers after CMP using a Therma-Wave OP-5340 was measured. The optical measurements were used to calculate the percentage of the wafer's surface area cleared of metal, which is denoted as $A_{clear}$. Perfect operation of the EPD system would result in a constant value of $A_{clear}$, despite changes in initial film thickness, polisher removal rate, etc. $A_{clear}$ provides a reference to judge whether the polish was stopped "at the same point" on the wafer.

Figure 9:
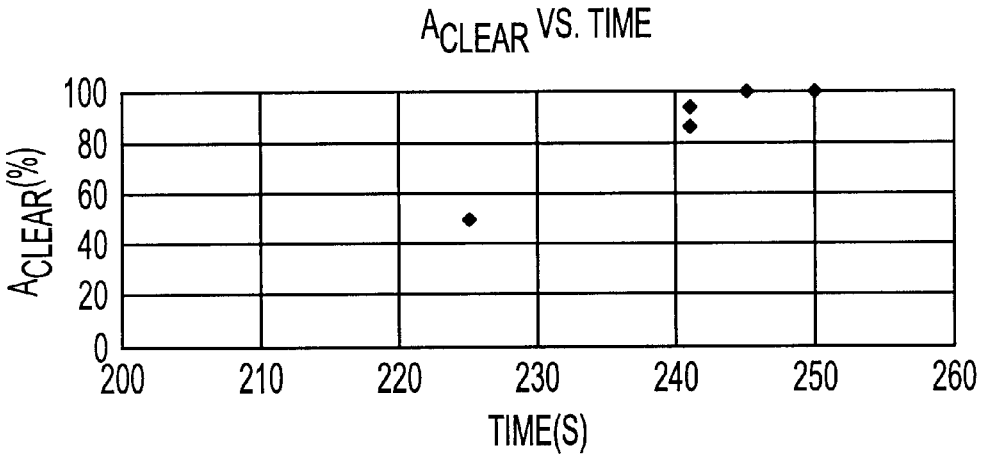
FIG. 9 shows percentage of wafer's surface cleared of metal as a function of polish time.
Figure 10:
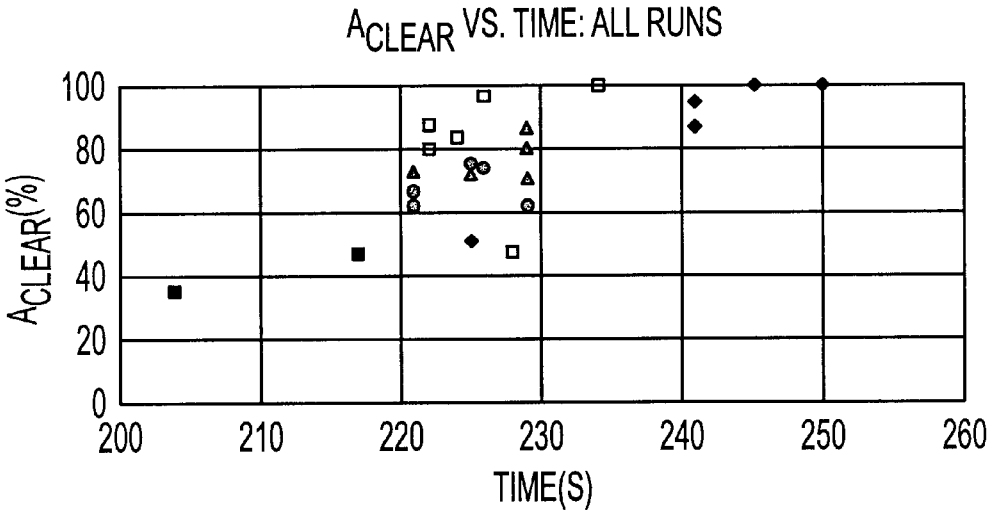
FIG. 10 shows percentage of wafer's surface cleared of metal as a function of polish time for all runs.

Before beginning the reliability tests, five blanket tungsten wafers were polished, varying the polish time. $A_{clear}$ was measured for these wafers and show the graph of $A_{clear}$ as a function of polish time in FIG. 9. Complete clearing of the metal layers is reached at approximately 245 s. Using this graph, a change in $A_{clear}$ can be related to an equivalent change in the polish time. For example, a change in $A_{clear}$ from 50% to 90% is equivalent to a change of polish time of approximately 15 s. Note, however, that the relationship between $A_{clear}$ is probably non-linear. FIG. 10 shows the data from all the blanket reliability tests with different days denoted by different symbols. Day to day shifts and even run to run variation in $A_{clear}$ of up to fifteen to twenty percent for a given polish time are observed.

Figure 11:
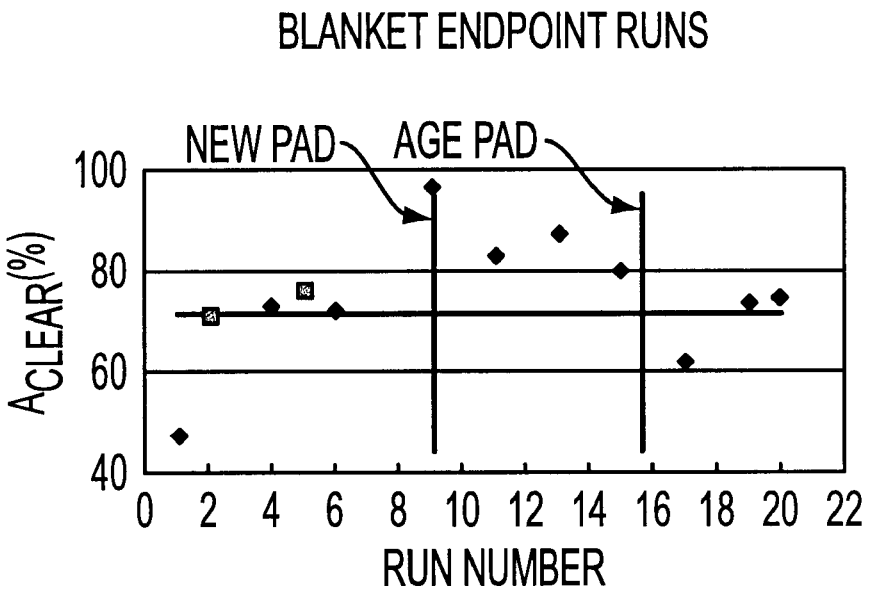
FIG. 11 shows percentage of wafer's surface cleared of metal for EPD-controlled runs.
Figure 12:
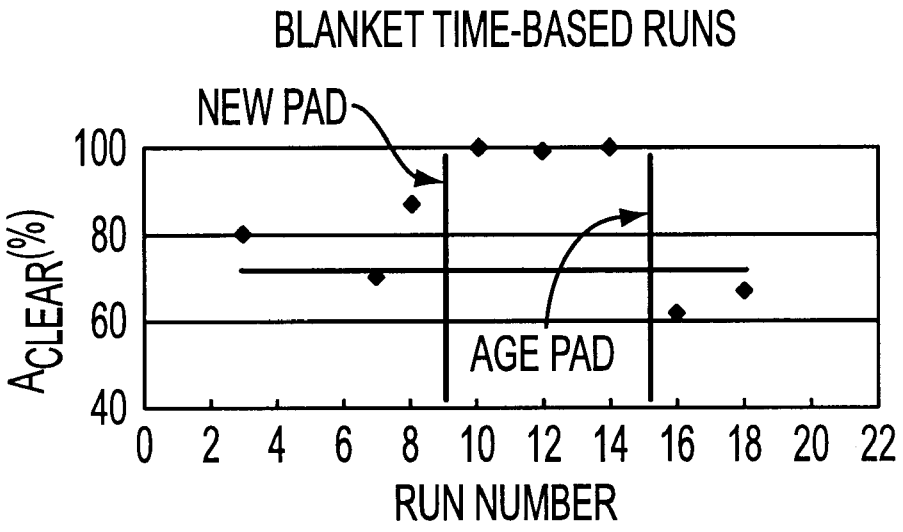
FIG. 12 shows percentage of wafer's surface cleared of metal for time-based polish runs.
Figure 13:
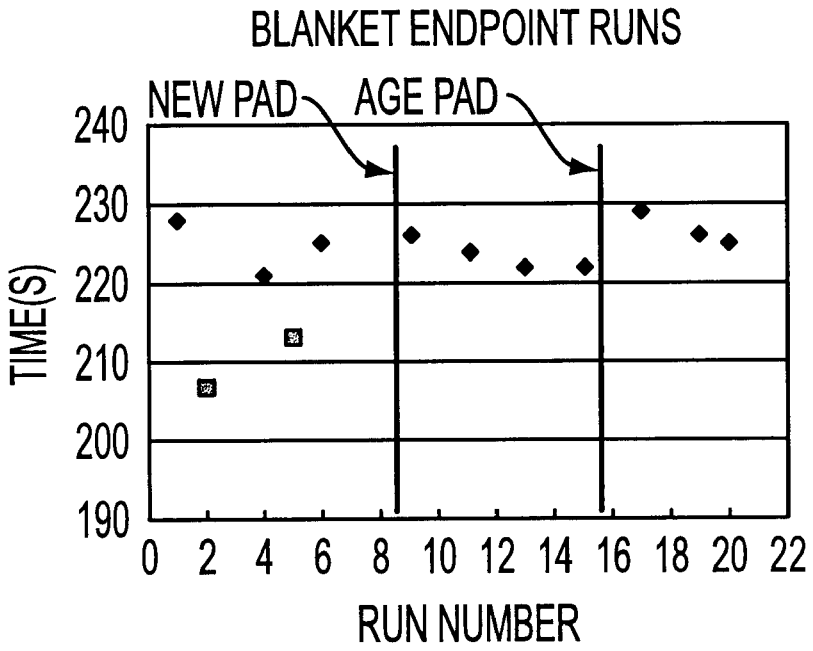
FIG. 13 shows polish times for the EPD-controlled runs.
Figure 14:
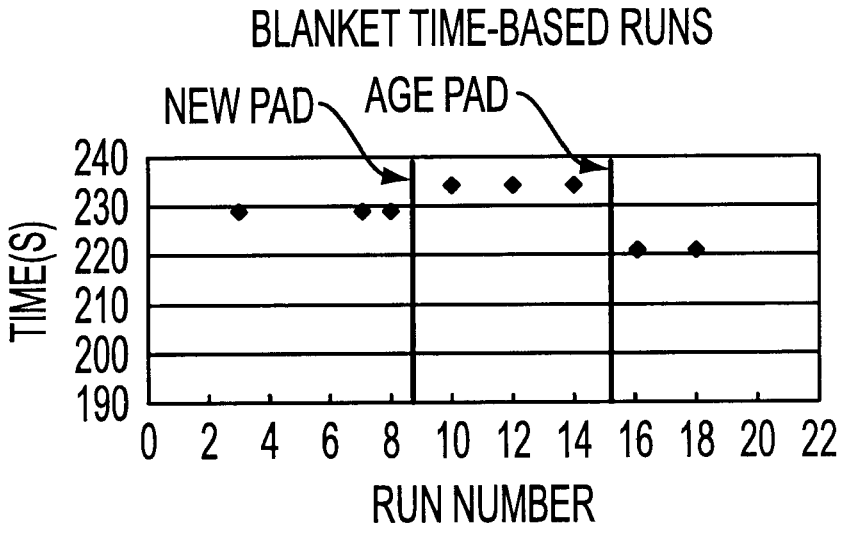
FIG. 14 shows polish time for time-based polishing runs.

The blanket wafer reliability results are summarized in FIG. 11–14. FIG. 11 shows $A_{clear}$ for the blanket EPD runs, and FIG. 12 shows similar data for the time-based runs. FIG. 13 and FIG. 14 show the corresponding polish times for the EPD and time-based runs, respectively. The polish time for the time-based runs was adjusted each day according to the removal rate measured on that day's monitor run. The shaded bars in FIG. 11 and FIG. 12 show the target value for $A_{clear}$, which was 72%.

b) Effect of Change in Film Thickness

The process removed approximately 200–250 Å of tungsten (or 4% of the original thickness) from two blanket tungsten wafers with a 15 s pre-polish. From FIG. 11 and FIG. 13, one sees that the EPD system responded effectively to the change in thickness, reducing the polish time and yielding approximately the same percentage clear of metal on pre-polished and as-deposited wafers. For runs 2 and 4–6, $A_{clear}$, varied from 72% to 76%, a very tight range. The first EPD run left more metal on the wafer, with $A_{clear}$, equal to 47%. See the next section for more discussion of this observation. These data demonstrate that the EPD system provides consistent process control despite variations in film thickness in the incoming wafers.

c) Effect of Dummy Runs

FIG. 11 shows that the first EPD run on each of the three days of testing deviated significantly more from the target percentage than subsequent runs. This result demonstrates that the sequence of dummy runs described above did not provide the best possible stability for the EPD system, even though day-to-day variation in the removal rate was not large. The data indicate that at least three runs of tungsten (one wafer per run) are desirable to achieve the best possible EPD stability.

d) Effect of Pad Change

After run 8, a new pad was installed. Both the time-based and EPD-controlled polish runs showed an increase in the percentage of the wafer cleared of metal. However, the EPD-controlled runs stayed closer to the target. The time-based runs cleared the wafer completely, whereas the average area cleared for the EPD runs was 87%. If this level of deviation exceeded allowable process limits, fine tuning of the EPD recipe would be required to reduce the overpolish of the wafer.

e) Effect of Pad Aging

At the end of run 15, approximately 87 $\mu$m of the pad had been consumed, an amount which corresponds to approximately one-third of the pad's useful life. To simulate aging of the pad, the pad was conditioned for 42 minutes, removing an additional 63 $\mu$m. This brought the total amount removed from the pad to 150 $\mu$m, representing 60% of the pad's useful life. As in the earlier tests, the first EPD run deviated most from the target. This deviation was likely caused by insufficient preparation of the pad, as discussed above in the section on effects of dummy runs. The second and third EPD runs, which yielded $A_{clear}$, values of 72% and 75%, were both quite close to the target value (72%). The time-based runs yielded $A_{clear}$ values of 62% and 67%, indicating that estimate of the polishing time required to hit the target was too low. The full sequence of the time-based runs, which includes some runs close to the target, some above, and then overcorrection causing subsequent runs to fall below the target, is the behavior of a feedback system whose parameters have not yet been optimized. More experience with the process and/or implementation of a closed-loop control feedback system would improve the performance of the time-based method, but the metrology requirements of this method would affect the system's throughput.

f) Analysis of $C_{pk}$

To obtain statistical information on the relative success of the time-based and EPD-controlled runs, the standard process capability which is denoted as $C_{pk}$ for a simulated process was calculated. The corrected capability index $C_{pk}$ is defined as follows:

$$C_{pk}=C_p(1-|k|)$$

where:

$$C_p=\Delta/6\sigma$$

is the capability index, Δ is the specification width (upper control limit minus the lower control limit), and σ is the standard deviation of the process error. The standard deviation σ is calculated using the difference of each process result from the mean of all the process results:

$$\sigma=\sqrt{\frac{n\sum X^2-(\sum X)^2}{n^2}}$$

where the process error X is defined as:

$$X=|x_i-\bar{x}|$$

The symbol $x_i$ denotes individual process results (values of $A_{clear}$, in this case) and x-bar represents the mean of these values. The centering index k measures the success of the process in achieving the target value for the process and is defined as follows:

$$k=\frac{\bar{x}-x'}{\Delta/2}$$

where x-prime is the target for process. For this analysis, the target was $A_{clear}$=72%, and an arbitrary specification width Δ of 30% was selected.

The result of the analysis is that the EPD system yielded a corrected capability index $C_{pk}$ of 0.47, compared to 0.12 for the time-based runs. Most of the improvement was in the value of the centering index k. The mean of the EPD-controlled runs was 75%, whereas the mean of the time-based runs was 83%, much further from the target of 72%. The factor-of-four improvement in $C_{pk}$ demonstrates the significant benefit which can be achieved using EPD.

C. Results for Patterned Tungsten EPD

The patterned wafer tests were run in parallel with the blanket wafer tests on the same system. The polish recipe was the same, but the EPD recipe was modified to work with the motor current signal for the blanket wafers. The patterned wafers used were Sematech's product code 926CMP023, and the layer stack was as follows:

5 kÅW/400ÅTiN/250ÅTi/5.5kÅPETEOS/Si.

1. Motor Current Signals

Figure 15:
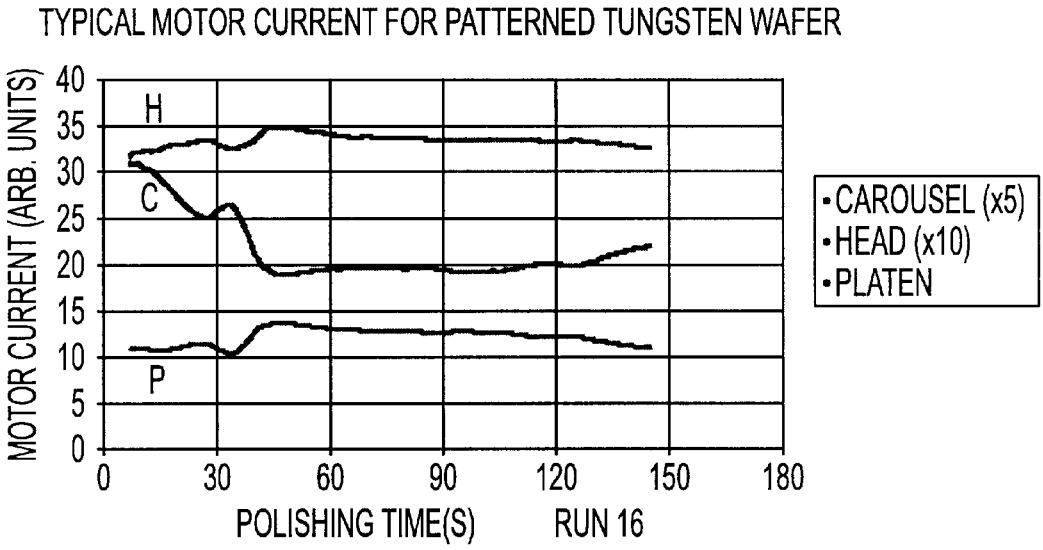
FIG. 15 shows typical motor current signals for patterned tungsten wafers from Sematech.
Figure 16:
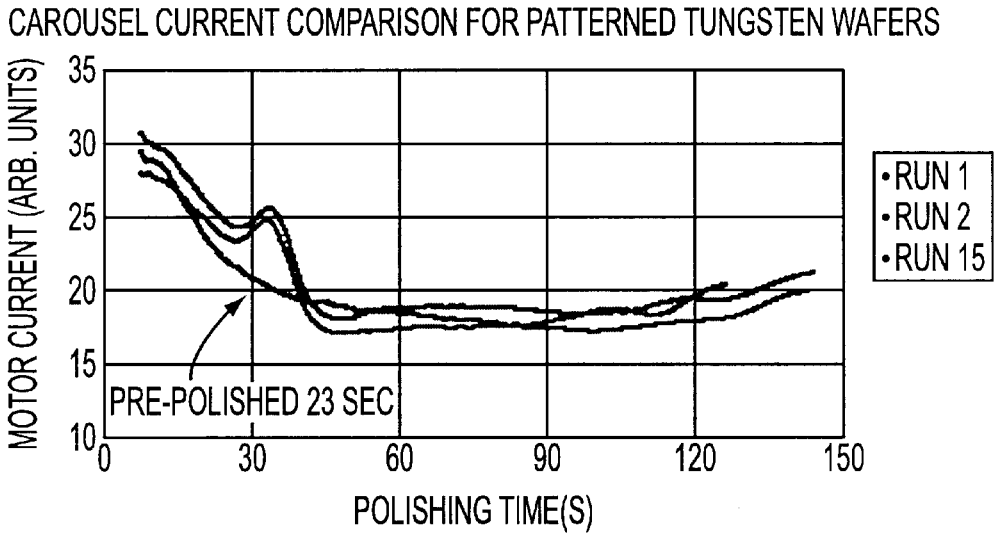
FIG. 16 shows a comparison of carousel current for various patterned wafer runs showing the reproducibility of the triggering feature.

FIG. 15 shows the shape of the motor current signals for a typical patterned W wafer. The features are much less abrupt than those seen in the case of the blanket wafer, as expected. The rise at approximately 130–140 s was chosen as the end-point trigger feature. FIG. 16 shows a comparison of the carousel current for several patterned wafers polished at different stages of pad life, including one pre-polished wafer.

2. Patterned Wafer W EPD Reliability a) Method For Measuring Reliability

As in the case of the blanket wafers, a quantitative method for evaluating the reliability of the EPD system was established. The erosion of a 2.5×2.5 $mm^2$ array of 0.5 μm contacts with a pitch of 1 μm were measured. The measurement was performed using a high-resolution profilometer (HRP-320 from KLA-Tencor). Two sites were measured on each wafer, one in a center die and one in an edge die.

Figure 17:
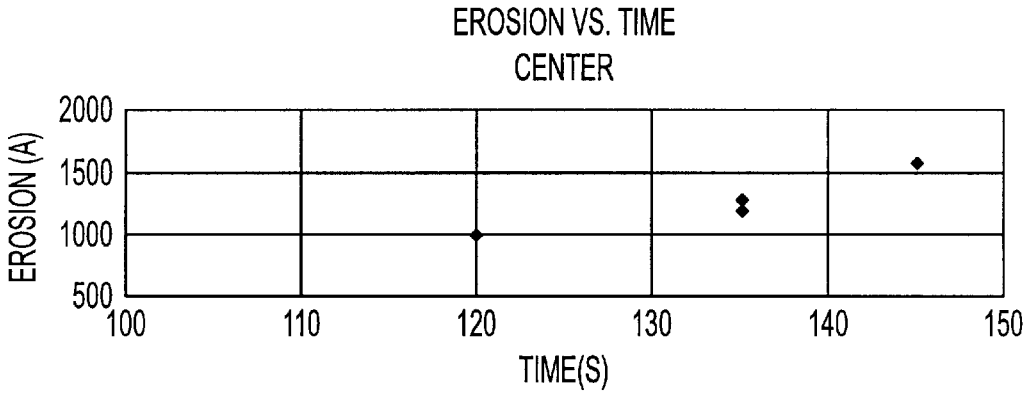
FIG. 17 shows oxide erosion in the center die as a function of polish time.
Figure 18:
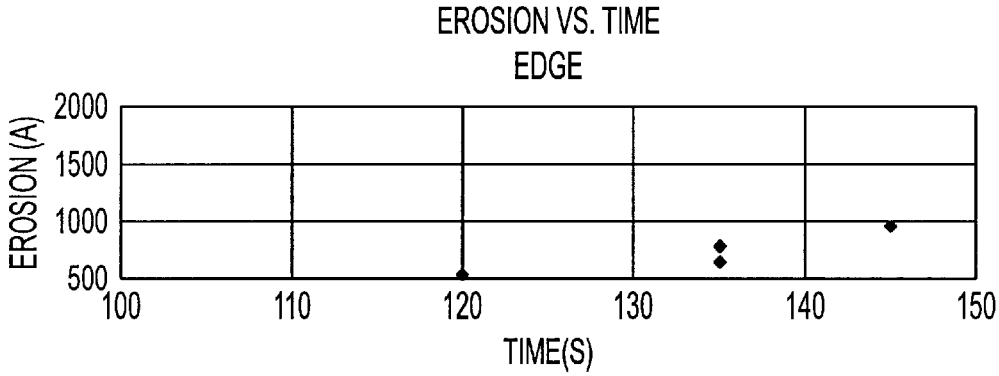
FIG. 18 shows oxide erosion in the edge die as a function of polish time.

First, erosion at both sites as a function of polishing time was measured, as shown in FIG. 17 and FIG. 18. As expected, erosion increases with polishing time, providing a method for comparing the results of end-point polish runs performed under different conditions. As in the case of the blanket wafers, perfect performance of the EPD system would correspond to no change in erosion as parameters such as wafer thickness and pad age are varied.

Figure 19:
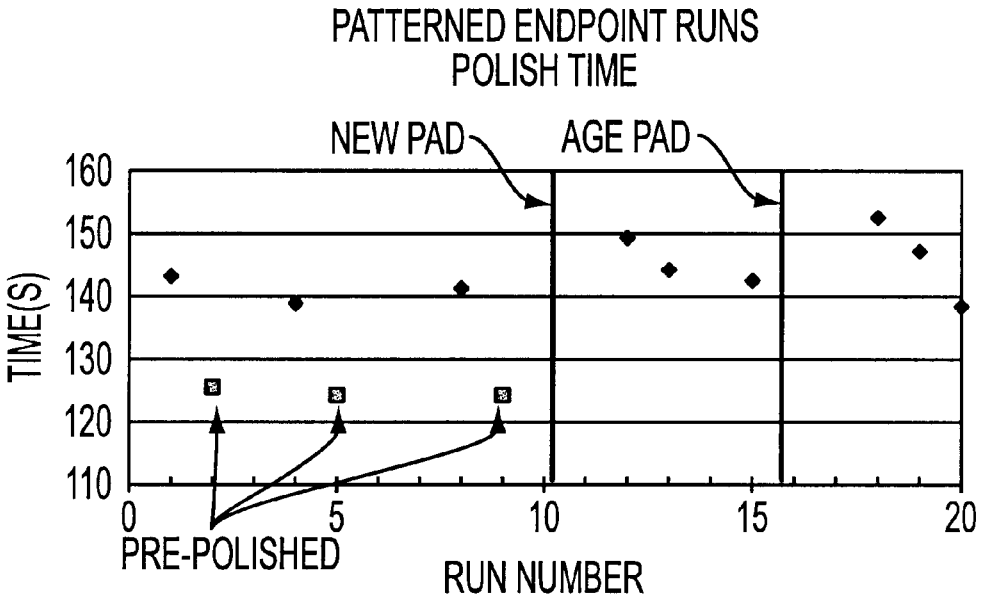
FIG. 19 shows polish times for EPD-controlled runs on patterned tungsten wafers.
Figure 20:
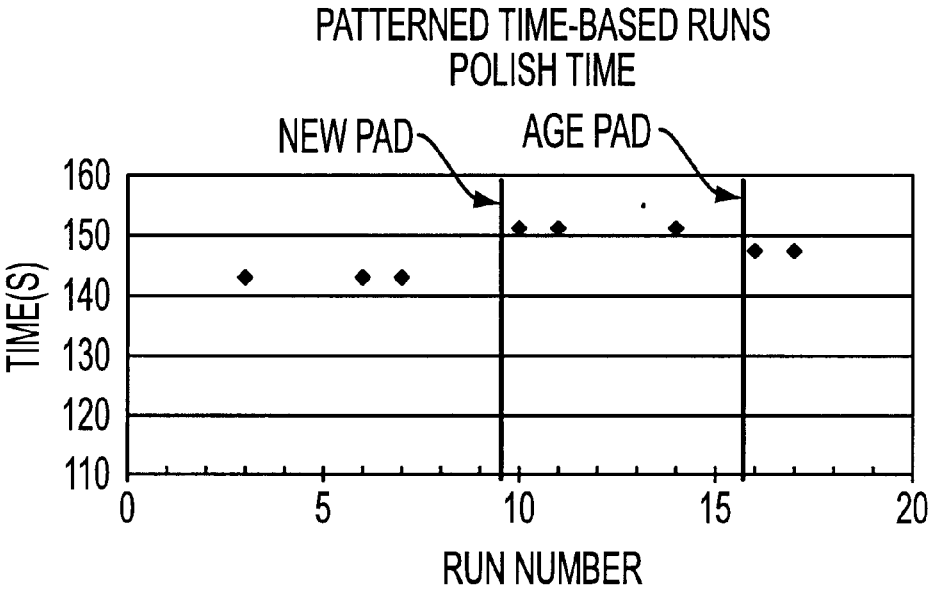
FIG. 20 shows polish times for time-based runs on patterned tungsten wafers.
Figure 21:
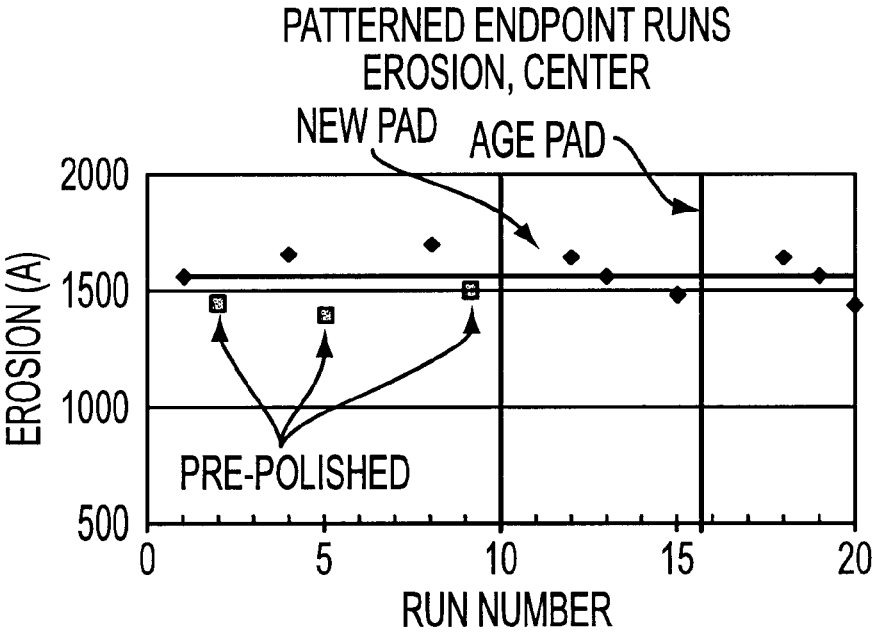
FIG. 21 shows erosion in the center die for EPD-controlled runs.
Figure 22:
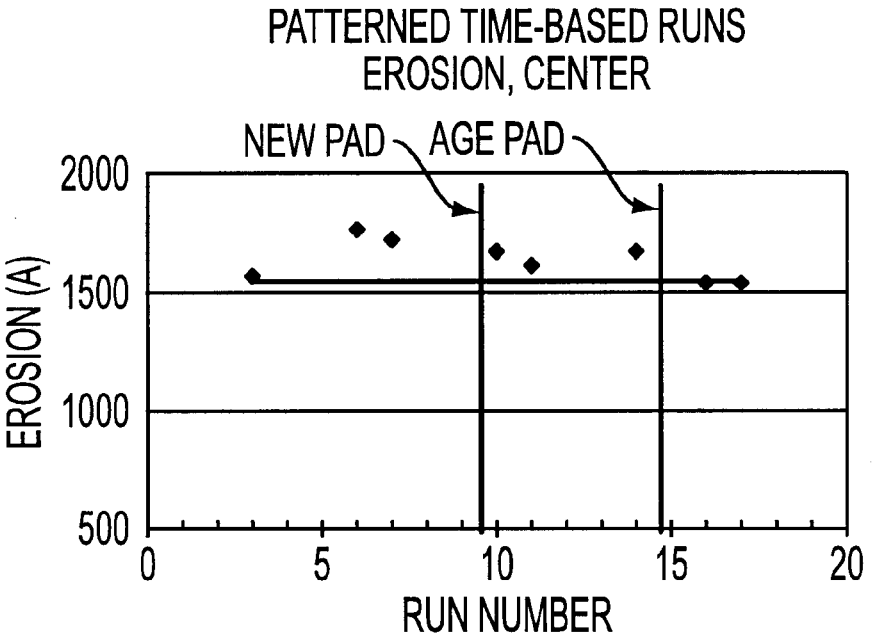
FIG. 22 shows erosion in the center die for time-based runs.
Figure 23:
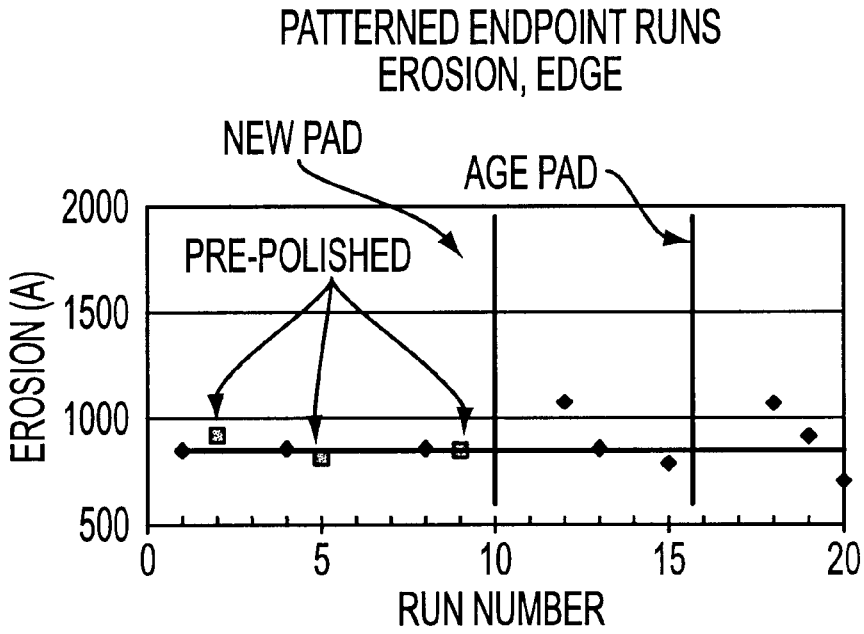
FIG. 23 shows erosion in the edge die for EPD-controlled runs.
Figure 24:
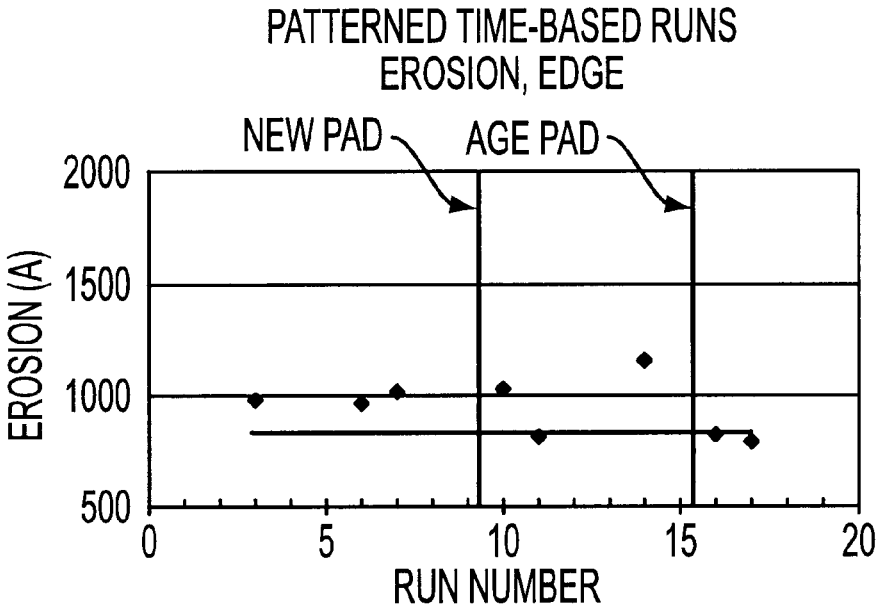
FIG. 24 shows erosion in the edge die for time-based runs, including the erosion target.

The polish times for EPD-controlled and time-based polishing of patterned wafers are shown in FIG. 19 and FIG. 20, respectively. Erosion results are shown in FIG. 21 through FIG. 24. The shaded lines represent the target erosion values.

b) Effect Of Change In Film Thickness

The effect of film thickness variation on the performance of the EPD system was studied in the patterned wafer Runs 1–9. Three patterned wafers were pre-polished for 23 s, resulting in removal of 13% of the tungsten film. These wafers were then polished using the same EPD recipe as three wafers which had the original, "as-deposited" tungsten thickness of 5 k Å. The tests found that the erosion in the center die was on average 170 Å greater for the as-deposited wafers than for the pre-polished wafers. For the edge die, the erosion was the same on both types of wafers to within 20 Å.

Considering the substantial change in film thickness between as-deposited and pre-polished wafers, the results demonstrate that the EPD system is able to maintain consistent process control despite film thickness variation.

c) Effect Of Pad Change

Following Run 9, a new pad was installed. Both the EPD-controlled and the time-based runs remained close to the target following the pad change. This result shows that the EPD system functioned successfully using the same EPD recipe both before and after the pad changed.

d) Effect Of Pad Aging

Following Run 15, an additional 63 μm of the pad was removed through continuous pad conditioning to simulate aging of the pad. The time-based polish runs remained close to the target. On the first EPD run, the system failed to recognize the triggering feature, and triggered the system manually. On examination of the motor current signal, it was apparent that the rise in slope was not great enough to trigger the original EPD recipe. The recipe was re-tuned slightly by reducing the size of the windows used in the triggering algorithm, and the following two runs triggered successfully, yielding erosion values close to the target value. This result demonstrates that some slight re-tuning of the EPD recipe may be required when polishing conditions are changed.

After all runs were completed, the data from the final two EPD runs was examined and found that both would have successfully triggered off of the original EPD recipe. This observation provides more evidence that the number of dummy runs used to prepare the pad was not sufficient, as discussed earlier. Establishment of an effective sequence of dummy runs is necessary to obtain the best consistency from the EPD system.

e) Analysis of $C_{Pk}$

As for blanket wafers, an analysis of the corrected process capability index $C_{pk}$. was performed. Analyzing the data from the center die, the data showed a $C_{pk}$ of 0.15 for the time-based polish runs, compared with 0.66 for the EPD runs. Our specification width was chosen to be 200 Å in this analysis. As in the case of blanket wafers, the use of the EPD system improved $C_{pk}$ by approximately a factor of four. Most of the improvement came from better centering of the process on the target.

D. Summary for Tungsten EPD

These results demonstrate that motor current end-point detection provides consistent and reliable control over polishing of tungsten wafers. The EPD system is able to trigger successfully despite changes in conditions such as changes in the film thickness of incoming wafers and change of the polishing pad. EPD provides significantly better centering of the process on its target when compared with time-based polishing.

IV. Other EPD Applications

The use of RTM in three other systems ws investigated: aluminum, copper, and shallow trench isolation (STI). A brief summary of the results on these systems is presented next. For aluminum, a detailed reliability test similar to the one for tungsten described in Section III was performed.

A. Aluminum

Our results for aluminum were similar to those for tungsten. Clear trigger signals were observed, and motor current RTM provided reliable, reproducible method of end-point detection. The consumable set for this work was as follows:

Slurry: EP-A5664, EP-A5680 from Cabot

Pad: IC-1400 A4 K-groove Rodel pad

Inserts: R200-T3 inserts from Rodel

Wafers: Blanket Al Wafers from WaferNet 12 k Å AlCu (0.5% Cu)/500 Å TiN/100 Å Ti/10 k Å Thermal Oxide/Si.

Figure 25:
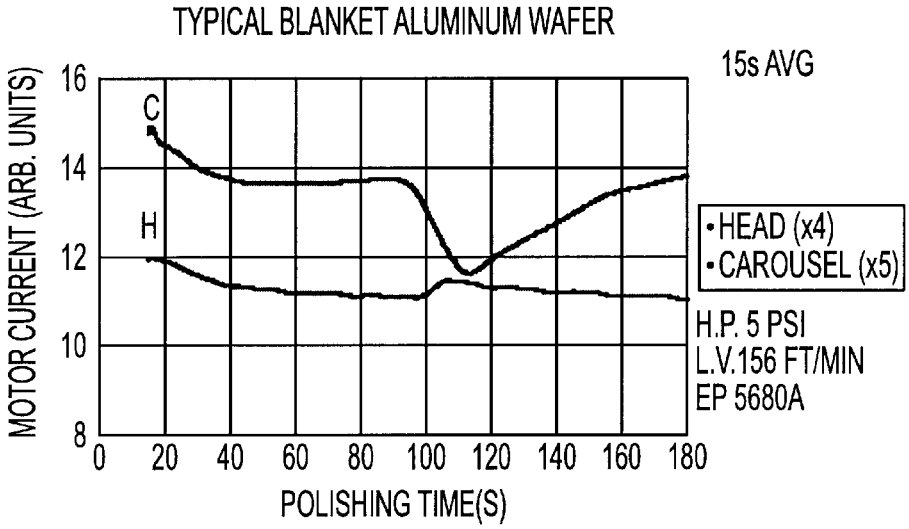
FIG. 25 shows motor current signals for a typical blanket aluminum wafer.
Figure 26:
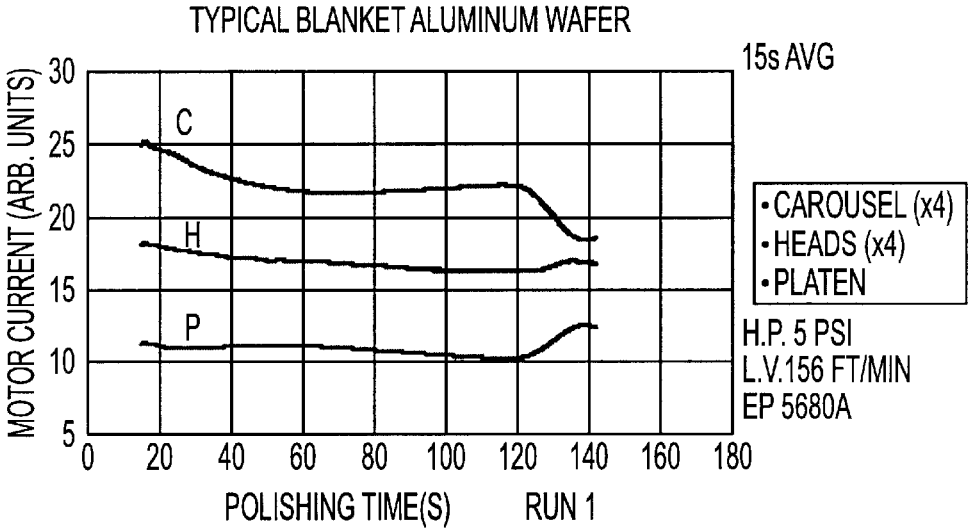
FIG. 26 shows motor current signals for a typical blanket aluminum wafer.
Figure 27:
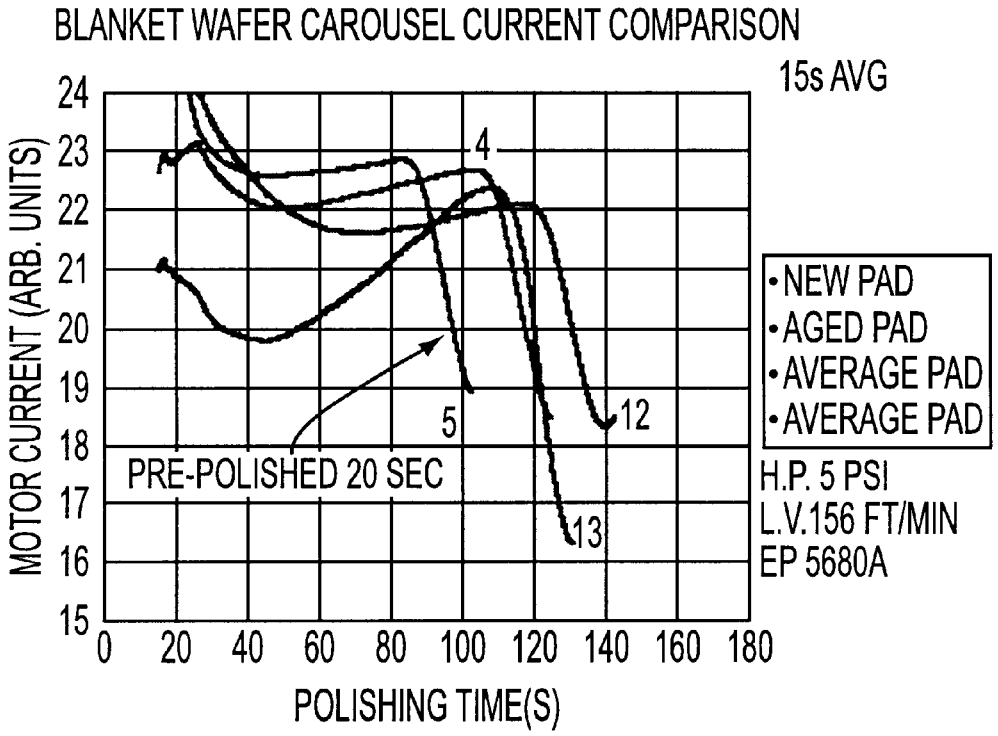
FIG. 27 shows a comparison of carousel current for several EPD runs, showing reproducibility of triggering feature.

Typical motor current signals for these wafers are shown in FIG. 25 and FIG. 26. A comparison of the carousel current from several runs is shown in FIG. 27. As for tungsten, there is good reproducibility of the triggering feature, and in moves to shorter time as expected when a (pre-polished) wafer with a smaller initial thickness is processed.

Figure 28:
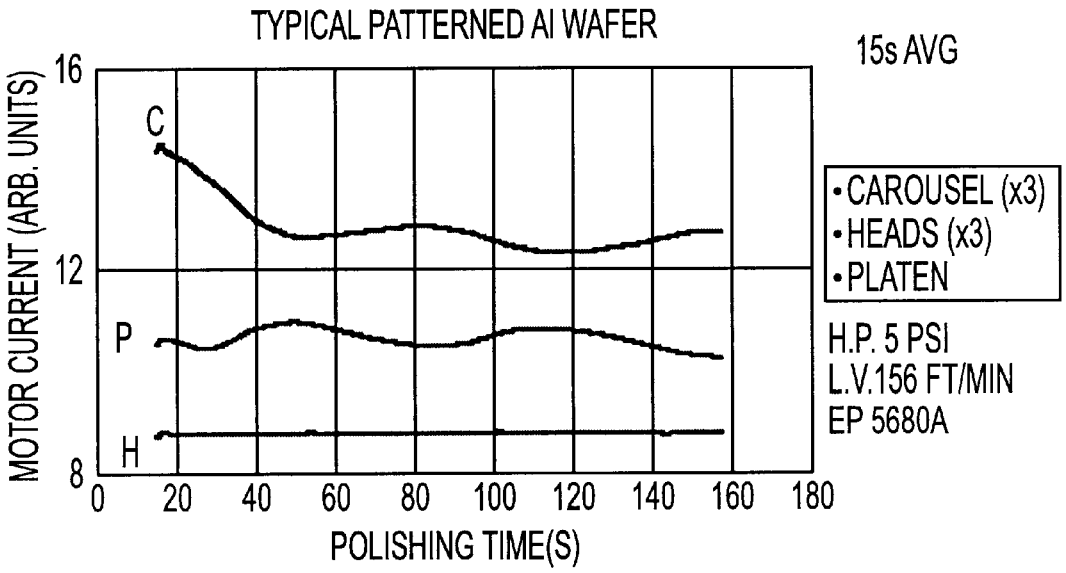
FIG. 28 shows typical motor current signals for a patterned aluminum wafer.
Figure 29:
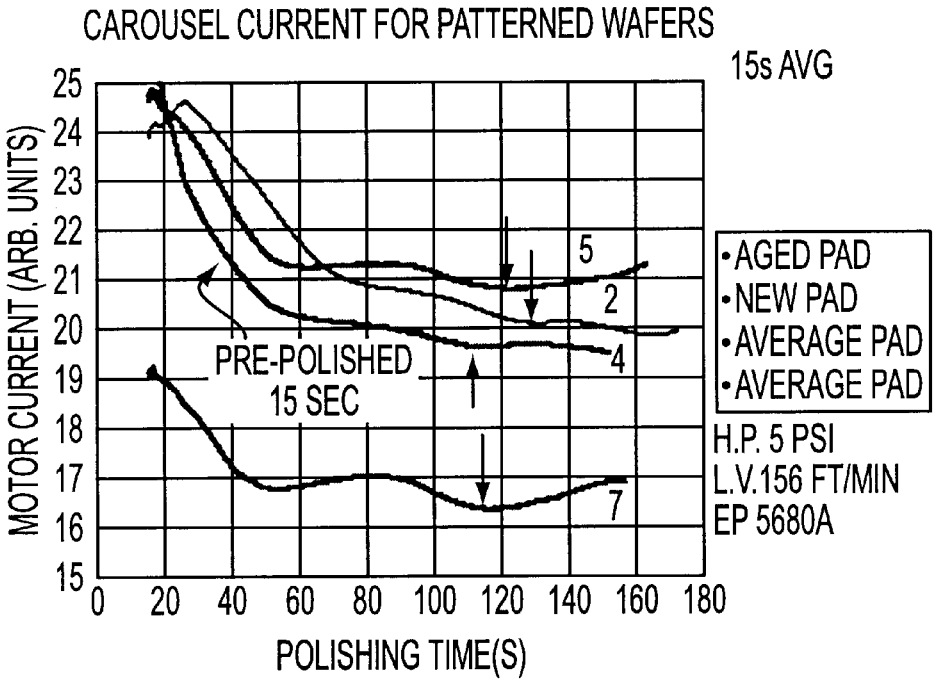
FIG. 29 shows a comparison of carousel current for several patterned aluminum wafers.

Patterned wafers from Sematech (product code 926CMP010) with the layer stack 250 Å TiN/6 k Å AlCu (0.5% Cu)/500 Å Ti/5.5 k Å PETEOS/Si were also polished using motor current EPD. Typical motor current signals for these wafers are shown in FIG. 28, and a comparison of the carousel current from several runs is shown in FIG. 29.

B. Copper

Figure 30:
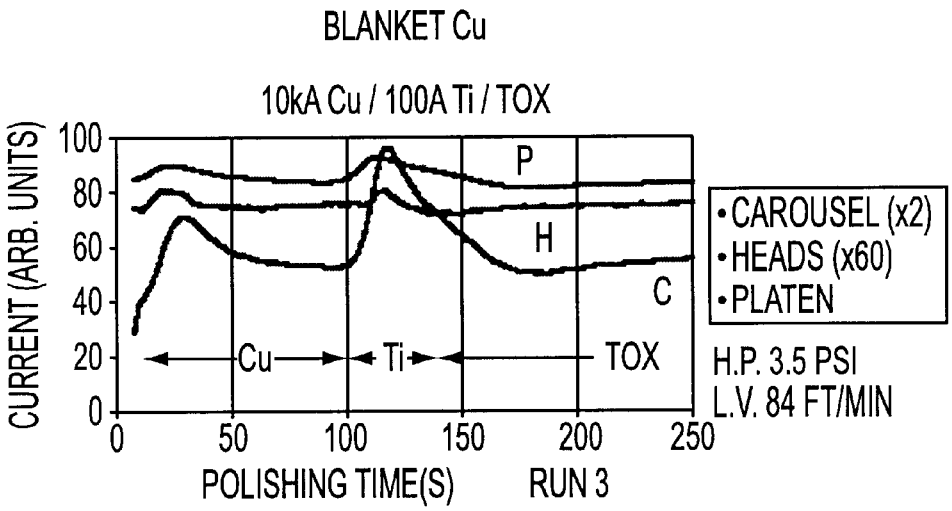
FIG. 30 shows motor current signals for single-step polish of blanket copper.
Figure 31:
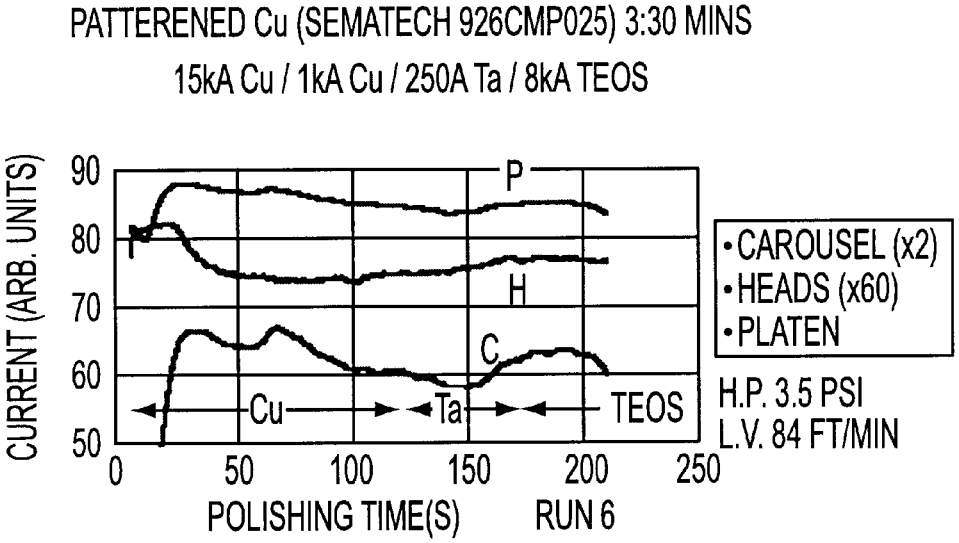
FIG. 31 shows motor current signals for single-step polish of patterned copper.

Initial efforts in copper process development at Cybeq focussed on a single-step process using Cabot's EP-C4110 slurry. Data for blanket and patterned wafers are shown in FIG. 30 and FIG. 31, respectively. These data were collected using three copper wafers and three dummy oxide wafers. One interesting feature of the data is that the symmetry between the platen and carousel is different than for the data shown above for tungsten and aluminum. The platen rotation was 24 rpm, and the carousel was 10 rpm, just as for the tungsten work. A correlation between this change in symmetry and the number of wafers polished was observed. When only one wafer is polished and all other heads retracted, the platen and carousel signals move in opposite directions as shown in the tungsten and aluminum work above. When multiple wafers are processed, this symmetry is changed.

Figure 32:
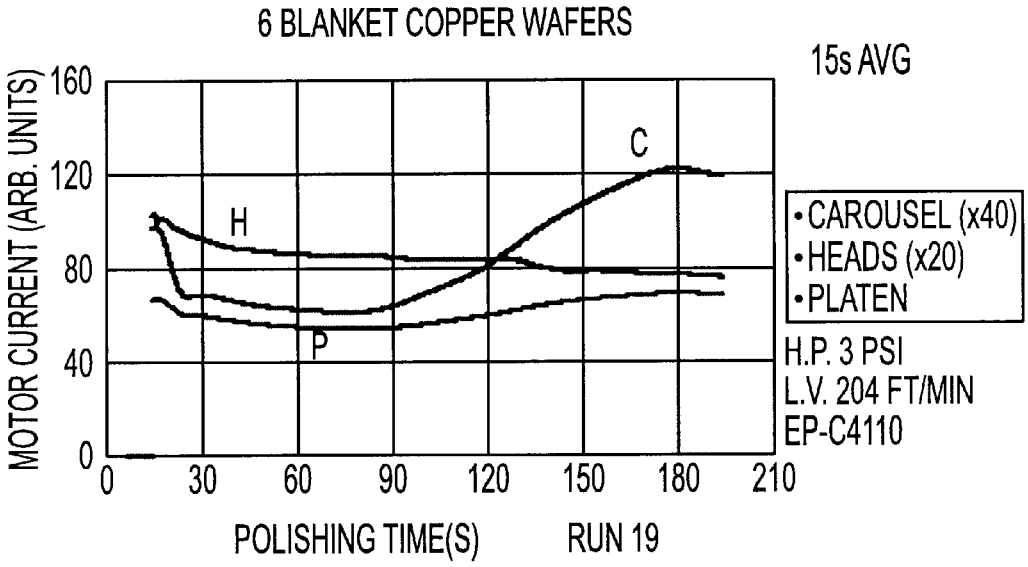
FIG. 32 shows motor current signals for copper polish during two-step copper process.

Because the single-step copper process yielded unacceptable erosion and dishing values, further process development focussed on a two-step process. The first step was a copper polish using EP-C4110, and the second step was for removal of the Ta barrier layer using a different slurry. The feasibility of performing a two-step end-point process was also investigated. The idea was to use the first end-point to signal the end of the copper layer and proceed to the Ta polish, and to use the second end-point to signal the end of the barrier polish and proceed to the rinse step. However, the results showed that the thin Ta barrier layer required a very brief polish of approximately 13 s. Because the system is changing rapidly throughout this short polish cycle (e.g., motors are ramping up in speed, slurry is being distributed, etc.) no reliable end-point signal was identified for the Ta polish. Moreover, since the polish was so brief, it was not considered to be necessary to perform end-point for this step. Therefore, it was concluded that the best strategy was to use end-point detection only for the copper polish step, and to control the Ta polish using time and not EPD. Examples of typical motor current signals for the copper polish step of this process are shown in FIG. 32.

C. Shallow Trench Isolation (STI)

Motor current RTM is not widely accepted as a suitable method of performing EPD for the shallow trench isolation application. A typical layer stack for STI is oxide/nitride/thin oxide/Si. However, some customers use a mask set which eliminates oxide over the active areas of the wafer (i.e., the areas covered with nitride). In this structure, the oxide fill is constrained to the trenches, and no oxide is found on nitride.

Figure 33:
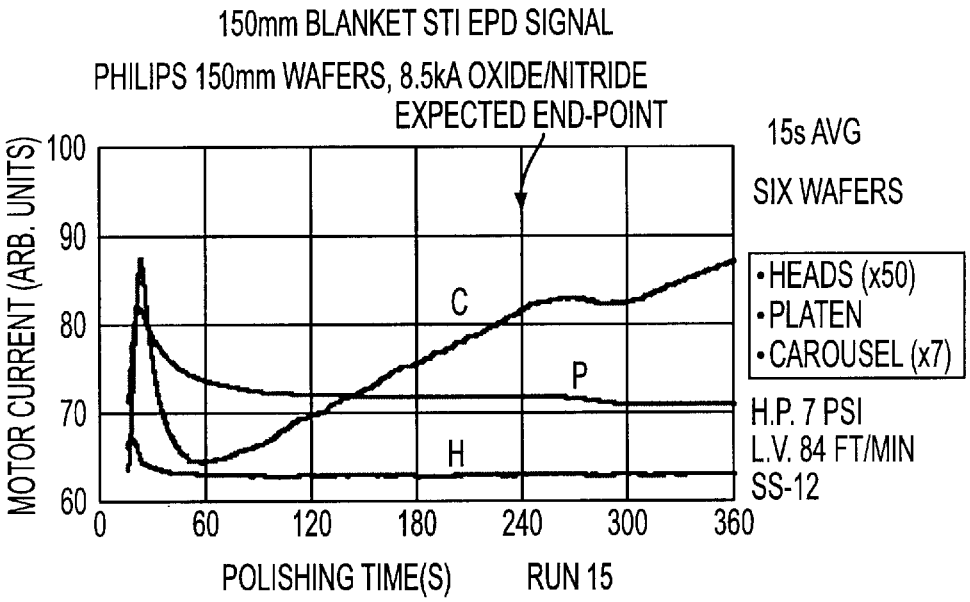
FIG. 33 shows motor current signals for 8.5 k Å blanket STI wafers.
Figure 34:
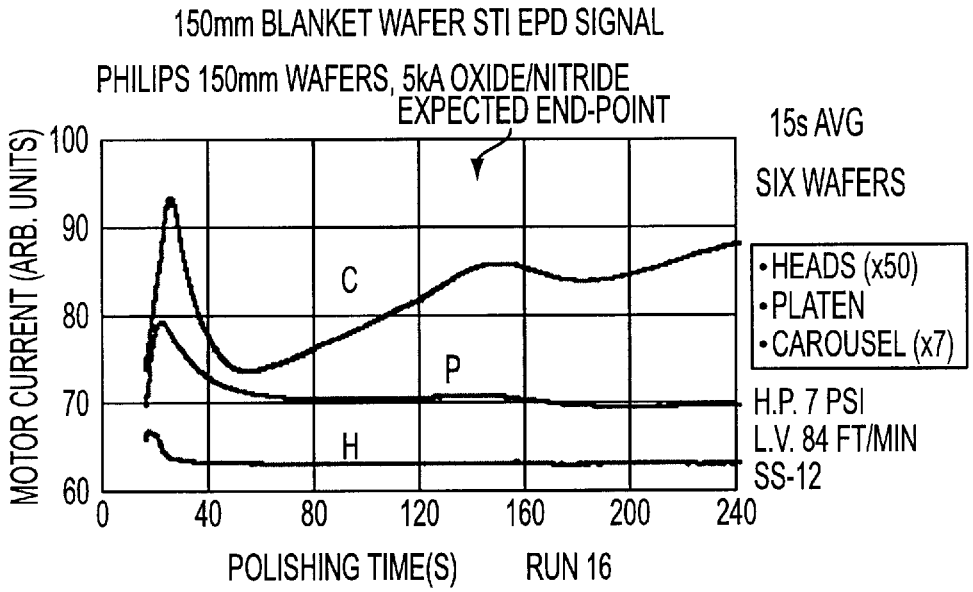
FIG. 34 shows motor current signals for 5 k Å blanket STI wafers.

The feasibility of using motor current EPD for STI. was investigated. The first work was performed on blanket 150 mm wafers from Philips Semiconductors in Albuquerque. The wafers were polished using SS-12 Slurry from Cabot Corporation, R200-T3 inserts from Rodel, and In IC-1400 k-groove pad also from Rodel. The head pressure and linear velocity were 7 psi and 84 fit/min. The motor current signals for an the oxide/nitride/oxide stack with an 8.5 k Å top-layer oxide film are shown in FIG. 33, and similar data for a 5 k Å film are shown in FIG. 34. The oxide removal rate was measured on a monitor oxide wafer and was found to be 2100 Å/min. The estimated time to clear the oxide layer is indicated with an arrow in the figures. A smooth, rounded peak in the carousel current was observed at approximately the time that clearing of the oxide was expected to occur. Based on this observation, it will feasible to use motor current RTM to provide an end-point detection solution for STI. However, it is noted that the signals shown in FIG. 33 and FIG. 34 are for six blanket wafers. In the case of metals, changing from blanket to patterned wafers and using partial loads of less than six wafers both tend to reduce the size of the EPD signal. Therefore, one expects that the use of motor current signals for EPD of STI would be much more challenging than for metals, and that motor current may not be the best approach for STI.

Figure 35:
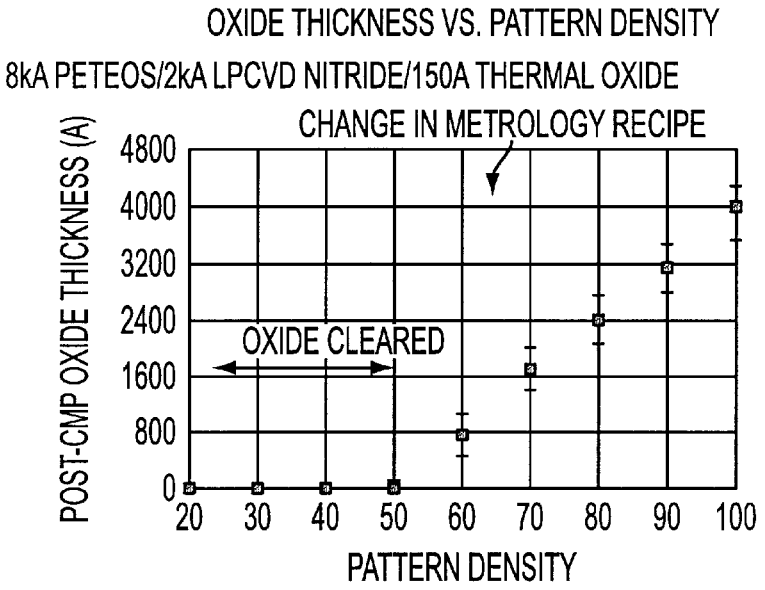
FIG. 35 shows oxide thickness as a function of pattern density for the MIT mask STI wafer after CMP.
Figure 36:
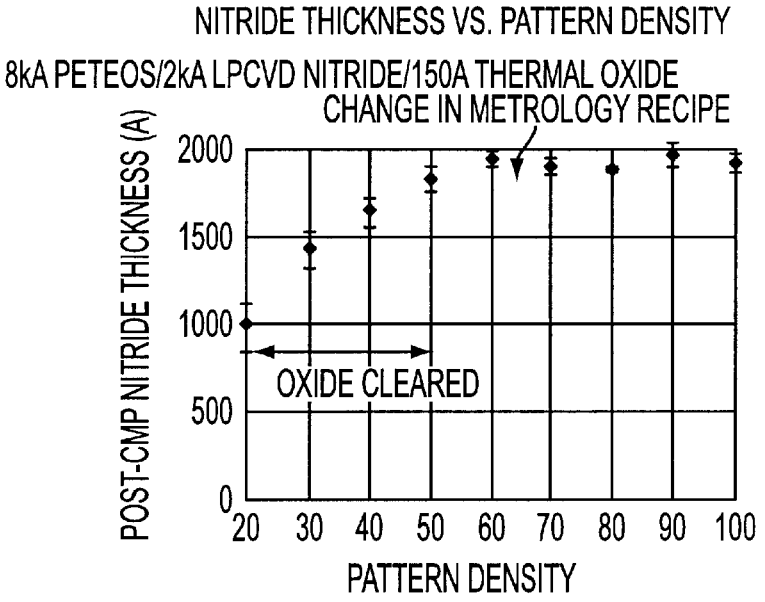
FIG. 36 shows nitride thickness as a function of pattern density for the MIT mask STI wafer after CMP.

Because of the difficulty of obtaining large numbers of patterned STI wafers from customers, the feasibility of using commercially available STI patterned wafers for EPD development as investigated. The only commercially available patterned STI wafers identified were based on the MIT mask set. The floorplan consists of 4×4 $mm^2$ regions with pattern densities ranging from 0 to 100% and linewidths from 0.5 $\mu$m to 500 $\mu$m. These wafers are used for characterizing the pattern dependence of the polishing process and are not suitable for EPD development. As shown in FIG. 35 and FIG. 36, pattern dependence effects are deliberately emphasized in this mask set, and regions with different pattern density clear at significantly different times.

Actual production wafers have a narrower range of effective pattern density. Dummy fill structures are used to raise low pattern density areas so that a minimum pattern density can be specified for the layout design. Furthermore, the pad interacts with the wafer surface over a characteristic distance known as the planarization length which is usually a few millimeters. The result of this pad-wafer interaction is that the pad responds to an average pattern density which is smoother and may vary less than the layout density range. Therefore, the question of whether motor current can be used for EPD of STI wafers remains open. Because motor current EPD is easier to integrate with the CMP system than optical methods, it is worthwhile measuring the motor current signals from production STI wafers to assess the feasibility of motor current EPD for this application.

V. Uses of Motor Current RTM for Applications Other Than EPD

Though the primary application of motor current RTM is for end-point detection, two other potential uses of motor current data have been identified. These ideas are included as examples of non-EPD applications of real-time monitoring.

A. Monitoring mechanical oscillations of the polisher with RTM

Figure 37:
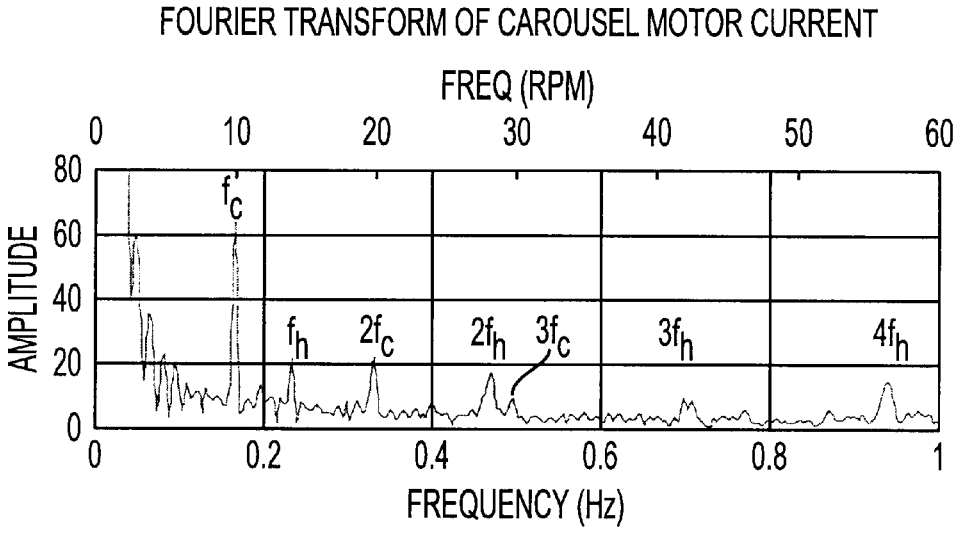
FIG. 37 shows Fourier Transform of carousel motor current.
Figure 38:
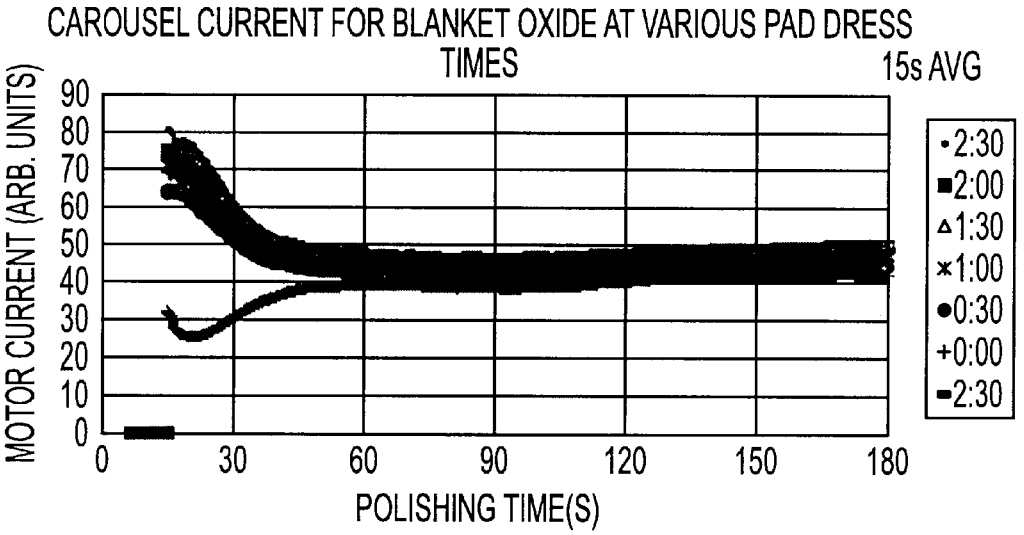
FIG. 38 shows carousel current for oxide polishing showing correlation with pad conditioning.

As shown in FIG. 6 , mechanical oscillations of the polisher affect the motor current signal and must be smoothed through signal averaging. To characterize these oscillations quantitatively, Fourier transform analyis of the motor current signal was performed, as shown in FIG. 37. The frequencies of the carousel and head rotations show up strongly in these data, along with harmonics at 2*f*, 3*f*, etc. The rotation frequencies show up in the motor current data because of limitations in the mechanical alignment of the tool. For example, there is always some misalignment of the platen and carousel planes, called the platen-carousel run-out. The rotation of the motors experiences resistance because of this run-out, and extra current is required from the motors to maintain constant rotational speed.

These frequency data are useful in two ways. First, they provide a quantitative method for finding the ideal periods over which to average the motor current signals. For example, a peak at 10 rpm or 0.167 Hz implies that the signal should be averaged at 1/f or 6 s, as shown in FIG. 6. Particularly when multiple frequencies are present, the Fourier transform method provides a fast, accurate method for finding the correct averaging times. Second, because the amplitude of these peaks relates to the mechanical misalignment of the system, it is likely that the Fourier spectrum can be used characterize the system and monitor its performance over time. The appearance of unusual frequencies or a significant change in the amplitude of the peaks are used as an indicator that maintenance of the system is required.

B. Correlation between Motor Current and Pad Conditioning

Another aspect of the motor current data which may be of use is its correlation with pad conditioning. The tests found that oxide wafers polished without pad conditioning had much less friction in the first 45 s of polishing. With full conditioning, the motor current starts at a high value and drops in the first 45 s. Without pad conditioning, this peak in the motor current is absent. With additional implementation effort the inventive method may be applied to use the motor current to optimize and monitor the pad conditioning. One could find the motor current signal which corresponds to sufficient conditioning, and periodically adjust the conditioning time to maintain this signal.

VI. Additional Description

The results have demonstrated that motor current RTM provides a successful method for performing EPD of tungsten and aluminum CMP applications. The results have documented the reliability of EPD triggering for these applications, and have shown a factor of four improvement in process stability relative to time-based polishing, and have also demonstrated feasibility for application of motor current to copper applications.

The results have shown that motor current RTM provides useful diagnostic data which can be used to monitor the system's mechanical alignment and its pad conditioning.

It can therefore be appreciated that the inventive structure and method provides particularly good performance (i.e., better reliability and higher precision of triggering) of a motor current end-point detection system when it is applied on a multiple-head chemical mechanical planarization (CMP) tool as well as when applied to the normal application on single-head CMP tools. The performance improvement comes from the larger surface area being polished (multiple wafers) and from the larger radius at which the force acts (the radius of the carousel).

It can also be appreciated that the inventive structure and method provide optimized end-point detection performance by performing a Fourier transform of the motor current to identify periodic oscillations in the current (such as from the rotation of the carousel or heads) which must be signal averaged to obtain the smoothest motor current trace. Use of the Fourier transform ensures that undesirable oscillations in the motor current are minimized, which provides better reliability and higher precision of end-point detection triggering.

It can further be appreciated that the inventive structure and method provide for optimizing the pad conditioning time in CMP through measurement of the motor current signal on blanket wafers. The motor current signal is strongly dependent on pad conditioning time, and the correlation can be used to identify the minimum pad conditioning time which will provide suitable performance (i.e., within-wafer nonuniformity, etc.) of the CNP tool. By minimizing the pad conditioning time, the life time of the pad is maximized.

All publications, patents, and patent applications mentioned in this specification are herein incorporated by reference to the same extent as if each individual publication or patent application was specifically and individually indicated to be incorporated by reference.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best use the invention and various embodiments with various modifications as are suited to the particular use contemplated. It is intended that the scope of the invention be defined by the Claims appended hereto and their equivalents.

I claim:

1. A method for detecting a planarization process step endpoint of a semiconductor wafer planarization operation, said method comprising:

monitoring a motor current signal for at least one motor responsible for a component of relative movement between said semiconductor wafer and a polishing pad;

performing a Fourier transform analysis of the monitored motor current signal to identify at least one motor current signal frequency component of said signal identifying a periodic mechanical oscillation arising from operational effects independent from planarization process step completion indicators;

filtering said at least one identified frequency component to suppress said periodic oscillations from said motor current signal and generating a filtered motor current signal in which motor current signal variations indicative of said planarization process step completion are preserved and more readily detectable relative to motor current at times other than said planarization process step endpoint; and detecting said planarization process step completion as a change in the filtered motor current signal;

said fourier transform analysis and filtering at said identified frequency component ensuring that an undesirable oscillation in the monitored motor current are minimized to thereby provide better reliability and higher precision of said planarization process step completion detection.

2. The method in claim 1, wherein said filtering comprising averaging said monitored motor current signal over a predetermined time period corresponding to said at least one identified frequency component.

3. The method in claim 1, wherein said performing a fourier transform analysis of the monitored motor current signal identifies a plurality of frequency components of said signal identifying a plurality of periodic mechanical oscillations arising from operational effects independent from planarization process step completion indicators, and said filtering filters said plurality of identified frequency components.

4. The method in claim 3, wherein at least one of said plurality of frequency components comprises a frequency corresponding to the rotational velocity of a polishing pad platen.

5. The method in claim 3, wherein at least one of said plurality of frequency components comprises a frequency corresponding to the rotational velocity of a multi-head carousel.

6. The method in claim 3, wherein at least one of said plurality of frequency components comprises a frequency corresponding to the rotational velocity of a single polishing head.

7. The method in claim 3, wherein said plurality of frequency components comprises a frequency corresponding to the rotational velocity of a polishing pad platen, a frequency corresponding to the rotational velocity of a multi-head carousel, and a frequency corresponding to the rotational velocity of a single polishing head.

8. The method in claim 1, wherein said planarization process step completion indicator includes a change in friction at the interface between two layers of said semiconductor wafer resulting in a detectable change in the filtered motor current signal.

9. The method in claim 8, wherein said motor comprises a platen motor and said change in the filtered motor current signal comprises a change in the platen motor current.

10. The method in claim 8, wherein said motor comprises a carousel motor and said change in the filtered motor current signal comprises a change in the carousel motor current.

11. The method in claim 8, wherein said motor comprises a head motor and said change in the filtered motor current signal comprises a change in the head motor current.

12. The method in claim 3, wherein the motor further comprise a platen motor, a carousel motor, and a head motor, and said averaging is performed for the platen motor signal by averaging over the period of the carousel rotation; the averaging is performed for the carousel motor signal by averaging over the period of the carousel rotation; and the averaging is performed for the head motor signal by averaging over the period of the carousel rotation and the head rotation.

13. The method in claim 3, wherein the motor further comprise a platen motor, a carousel motor, and a head motor, motor torques of the platen motor and carousel motor act together so that the platen motor current signal and the carousel motor current signal at a metal/oxide interface of said semiconductor wafer are both used to provide a stronger signal than the head motor current signal and provide stronger signals for said planarization process step completion detection.

14. The method in claim 3, wherein said averaging is performed for the platen motor signal by averaging over the period of the carousel rotation; the averaging is performed for the carousel motor signal by averaging over the period of the carousel rotation; and the averaging is performed for the head motor signal by averaging over the period of the carousel rotation and the head rotation.

15. The method in claim 3, wherein the frequency component comprises a frequency component of about 0.1 Hz.

16. The method in claim 3, wherein said method further comprises fourier transform analyzing said monitored motor signal at predetermined successive intervals to identify newly present frequency components or a change in the amplitude of previously present frequency components, and identifying a maintenance condition in response to the presence of said identified new or changed frequency components.

17. The method in claim 1, wherein said method further comprises monitoring said motor current signal to identify a polishing pad conditioning completion.

18. A substrate planarization process endpoint detection system comprising:

a motor current monitoring circuit adapted to receive an input signal indicative of a motor current signal for at least one motor responsible for a component of relative movement between said semiconductor wafer and a polishing pad;

a processor receiving said input signal and generating a fourier transform of said input signal;

identification logic identifying at least one frequency component of said input signal identifying a periodic mechanical oscillation arising from operational effects independent from planarization process step completion indicators;

a filter for filtering said at least one identified frequency component to suppress said periodic oscillations from said input signal and generating a filtered signal in which motor current variations indicative of said planarization process step completion are preserved and more readily detectable relative to motor current at times other than said planarization process step endpoint; and a detection circuit for detecting said planarization process step completion as a change in the filtered motor current signal;

said fourier transform and filtering at said identified frequency component ensuring that an undesirable oscillation in the monitored motor current are minimized to thereby provide better reliability and higher precision of said planarization process step completion detection.

19. The system in claim 18, wherein said at least one motor is selected from the group of motors consisting of a polishing pad platten motor, a multi-head polishing machine carousel motor, and a polishing head motor.

20. A method for detecting a planarization process step endpoint of a semiconductor wafer planarization operation in a CMP planarization process, said method comprising:

monitoring a plurality of motor current signals for at least one platen motor and one head motor responsible for a component of relative movement between said semiconductor wafer and a polishing pad;

performing a fourier transform analysis of the monitored motor current signals to identify at least one motor current signal frequency component and harmonics thereof of said signal identifying periodic mechanical oscillation arising from platen and head rotation offsets independent from planarization process step completion indicators;

filtering said identified frequency components to suppress said periodic oscillations from said motor current signals and generating filtered motor current signals in which motor current signal variations indicative of said planarization process step completion are preserved and more readily detectable relative to motor current at times other than said planarization process step endpoint; and detecting said planarization process step completion as a change in one or more of the filtered motor current signals;

said fourier transform analysis and filtering at said identified frequency component ensuring that an undesirable oscillation in the monitored motor currents are minimized to thereby provide better reliability and higher precision of said planarization process step completion detection;

at least one of said plurality of frequency components comprises a frequency corresponding to the rotational velocity of a polishing pad platen, and at least one of said plurality of frequency components comprises a frequency corresponding to the rotational velocity of a single polishing head.

21. The method in claim 20, wherein said filtering includes averaging performed for the platen motor signal by averaging over the period of a carousel rotation; and the averaging is performed for the head motor signal by averaging over the period of the carousel rotation and the head rotation.

* * * * *